US007263932B2

(12) United States Patent
Winter et al.

(10) Patent No.: US 7,263,932 B2
(45) **Date of Patent: *Sep. 4, 2007**

(54) PERSONAL TABLE

(75) Inventors: David C. Winter, Layton, UT (US); Jay Jones, Clearfield, UT (US); Stephen F. Nye, Syracuse, UT (US); Brandon Smith, Ogden, UT (US); Kent Ashby, Logan, UT (US); L. Curtis Strong, Clearfield, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/038,375

(22) Filed: Jan. 18, 2005

(65) Prior Publication Data

US 2005/0126451 A1 Jun. 16, 2005

Related U.S. Application Data

(63) Continuation of application No. 10/340,018, filed on Jan. 9, 2003, now Pat. No. 6,912,961, and a continuation-in-part of application No. 29/167,628, filed on Sep. 18, 2002, now Pat. No. Des. 469,996, and a continuation-in-part of application No. 29/167,624, filed on Sep. 18, 2002, now Pat. No. Des. 469,994, and a continuation-in-part of application No. 29/167,611, filed on Sep. 18, 2002, now Pat. No. Des. 470,352.

(60) Provisional application No. 60/421,221, filed on Oct. 25, 2002, provisional application No. 60/364,712, filed on Mar. 14, 2002, provisional application No. 60/347,556, filed on Jan. 9, 2002.

(51) Int. Cl.
*A47B 3/02* (2006.01)

(52) U.S. Cl. ..... 108/118; 108/116

(58) Field of Classification Search ..... 108/118, 108/116, 115, 119, 120, 132; 248/161, 423, 248/157, 164, 439, 168, 188.1, 188.2, 188.6
See application file for complete search history.

(56) References Cited

U.S. PATENT DOCUMENTS 544,603 A 8/1895 Thompson (Continued)

FOREIGN PATENT DOCUMENTS

CA 717372 9/1965

(Continued)

OTHER PUBLICATIONS

Declaration of Maxine Lesht in Support of GSC's Response to Lifetime's Motion for Temporary Restraining Order and Preliminary Injunction of the GSC "Enduro2" Personel Table, 18 pages (including Exhibits 1-2), Oct. 5, 2003. *Lifetime Products v. GSC Technology Corporation, Case No. 1:03CV00062TC* (N.D. Utah).

(Continued)

*Primary Examiner*—Jose V. Chen
(74) *Attorney, Agent, or Firm*—Workman Nydegger

(57) ABSTRACT

A personal table is provided having a table top supported by a support assembly. The table top is preferably constructed from blow-molded plastic and the support assembly preferably includes a first leg and a second leg that are pivotally connected. The legs desirably have a generally X-shaped configuration when the legs are placed in an upright position and the legs can be collapsed into a storage position. Each of the legs may include a lower portion, a body portion and an upper portion that is preferably selectively connected to the table top. The legs, for example, can be connected to the table top by inserting the upper portions of the legs into leg receiving recess formed in the table top. The leg receiving recesses are preferably integrally formed in the bottom surface of the table top as part of a one-piece construction. Desirably, a plurality of leg receiving recesses are formed in the bottom surface of the table top and the legs can be selectively attached to the leg receiving recesses in order to vary the height of the table.

27 Claims, 18 Drawing Sheets

U.S. PATENT DOCUMENTS

| | | | |
|---|---|---|---|
| 2,675,286 | A | 4/1954 | Derman |
| 2,692,807 | A | 10/1954 | Cordola |
| D175,939 | S | 11/1955 | Gettelman |
| 2,834,644 | A | 5/1958 | Johansson et al. |
| 2,857,228 | A | 10/1958 | Koett |
| 2,879,118 | A | 3/1959 | Kolb |
| 2,912,775 | A | 11/1959 | Gettelman |
| 3,031,243 | A | 4/1962 | Crenoi |
| 3,094,948 | A | 6/1963 | Clow |
| 3,108,550 | A | 10/1963 | Knoblock |
| 3,224,389 | A | 12/1965 | Kent |
| 3,247,811 | A | 4/1966 | Bauder |
| 3,405,587 | A | 10/1968 | Meazzi et al. |
| 3,685,824 | A | 8/1972 | Quinn |
| 3,906,848 | A | 9/1975 | Gow |
| 3,954,068 | A | 5/1976 | Roberts et al. |
| 4,099,469 | A | 7/1978 | Sahli |
| 4,105,271 | A | 8/1978 | Sebel et al. |
| 4,168,669 | A | 9/1979 | Arnoff |
| 4,196,675 | A | 4/1980 | Cook |
| 4,248,161 | A | 2/1981 | Adair et al. |
| 4,433,869 | A | 2/1984 | Payne et al. |
| 4,944,235 | A | 7/1990 | Jahnke et al. |
| 4,951,576 | A | 8/1990 | Cobos et al. |
| 5,086,711 | A | 2/1992 | Matthews |
| 5,272,825 | A | 12/1993 | Simpson |
| 5,353,715 | A | 10/1994 | Luyk |
| 5,358,204 | A | 10/1994 | Terada |
| D353,286 | S | 12/1994 | Hand |
| D355,091 | S | 2/1995 | Green et al. |
| 5,394,808 | A | 3/1995 | Dutro et al. |
| D358,954 | S | 6/1995 | Leduc |
| 5,465,673 | A | 11/1995 | Ma |
| 5,483,901 | A | 1/1996 | Tisbo et al. |
| D366,781 | S | 2/1996 | Cartwright |
| 5,509,360 | A | 4/1996 | Chiu |
| 5,603,267 | A | 2/1997 | Soper |
| 5,644,994 | A | 7/1997 | Liang et al. |
| 5,848,822 | A | 12/1998 | Wu |
| 5,909,713 | A | 6/1999 | Liaw |
| D412,831 | S | 8/1999 | Murakami |
| D416,148 | S | 11/1999 | Pagnon et al. |
| 6,019,050 | A | 2/2000 | Ranta |
| 6,112,674 | A | 9/2000 | Stanford |
| 6,327,800 | B1 | 12/2001 | Daams |
| D452,626 | S | 1/2002 | Petri |
| D452,787 | S | 1/2002 | Petri |
| 6,399,015 | B1 | 6/2002 | Dranger |
| 6,401,630 | B1 | 6/2002 | Peterson |
| D468,135 | S | 1/2003 | Ashby et al. |
| D469,994 | S | 2/2003 | Smith |
| D469,996 | S | 2/2003 | Ashby |
| D470,352 | S | 2/2003 | Strong |
| 6,520,094 | B2 | 2/2003 | Wen |
| 6,530,331 | B2 | 3/2003 | Stanford |
| 6,550,404 | B2 | 4/2003 | Stanford |
| D481,567 | S | 11/2003 | Ashby et al. |
| 6,912,961 | B2 * | 7/2005 | Winter et al. ..... 108/118 |
| 2002/0152934 | A1 | 10/2002 | Haney |

FOREIGN PATENT DOCUMENTS

| | | |
|---|---|---|
| CA | 1235643 | 4/1988 |
| GB | 2216073 | 10/1989 |

OTHER PUBLICATIONS

Blow Mold Products/Outdoor Products, Dongguan Shichang Metals Factory Co., Ltd., 4 pages, Date Unknown (copyright notice includes the years 2002-2003).

Mosaic, profile edge in center, Gunlock Co. ©2003, p. 3.

Notification of the First Examination Report for Chinese Application No. 038000032, 2 pages.

* cited by examiner

PERSONAL TABLE

CROSS-REFERENCE TO RELATED APPLICATIONS

This application is a continuation of U.S. patent application Ser. No. 10/340,018, filed Jan. 9, 2003, entitled PERSONAL TABLE now U.S. Pat. No. 6,912,961. U.S. patent application Ser. No. 10/340,018 claims priority to and the benefit of U.S. provisional patent application Ser. No. 60/347,556, filed Jan. 9, 2002, entitled PERSONAL TABLE; U.S. provisional patent application Ser. No. 60/364,712, filed Mar. 14, 2002, entitled PERSONAL TABLE; and U.S. provisional patent application Ser. No. 60/421,221, filed Oct. 25, 2002, entitled PERSONAL TABLE. In addition, U.S. patent application Ser. No. 10/340,018 is a continuation-in-part of U.S. design patent application Ser. No. 29/167,624, filed Sep. 18, 2002, entitled TABLE LEG, now U.S. Pat. No. D469,994; U.S. patent application Ser. No. 10/340,018 is also a continuation-in-part of U.S. design patent application Ser. No. 29/167,628, filed Sep. 18, 2002, entitled TABLE TOP, now U.S. Pat. No. D469,996; and U.S. patent application Ser. No. 10/340,018 is a continuation-in-part of U.S. design patent application Ser. No. 29/167,611, filed Sep. 18, 2002, entitled TABLE TOP, now U.S. Pat. No. D470,352. Each of these patents and applications are expressly incorporated herein by reference in their entireties.

BACKGROUND OF THE INVENTION

1. Field of the Invention

The present invention generally relates to tables and, in particular, to a light-weight table that may be adjustable in height and may have legs that can be collapsed into a storage position.

2. Description of Related Art

Conventional tables are used for a variety of purposes and come in a wide array of designs. In some situations, it is desirable to have a smaller table for personal or individual use. For example, persons living in a small space, such as a studio apartment, may choose to use a smaller personal-sized table on which to dine or perform other tasks. Other persons may use a personal table to place beside a chair for the convenience of holding objects while reading, watching television or listening to the radio. Still others may use personal tables to perform tasks such as writing, working, or using a computer.

Conventional tables often include table tops constructed from wood, particle board or metal. Table tops constructed from wood, particle board or metal, however, are often relatively heavy and this may make the table awkward or difficult to move. Conventional table tops constructed from wood or metal are also relatively expensive and the table tops must generally be treated or finished before use. For example, table tops constructed from wood must generally be sanded and painted, and metal table tops must be formed into the desired shape and painted. In addition, these relatively heavy table tops increase the cost of transportation, shipping, and storage of the tables.

In order to decrease the weight of conventional tables, table tops can be constructed from relatively thin, light-weight materials. Disadvantageously, these light-weight table tops frequently require reinforcing members or other structural parts such as frames, railings, brackets and the like to strengthen the table top. These additional parts may increase the strength of the table top, but these additional parts also increase the weight of the table. In addition, these additional parts increase manufacturing costs and require additional time to assemble the table. Furthermore, these additional parts may have sharp edges that can injure the user's legs, arms or other body parts.

Known tables may also allow the height of the table to be adjusted to suit the needs of the user. For example, the length of the table legs may be increased or decreased by a telescoping assembly. Disadvantageously, because the telescoping assemblies include overlapping components, the assembly is relatively heavy. Additionally, conventional tables may use other mechanisms to allow the height of the table to be adjusted, but these devices are often relatively complex and require additional parts, which increases the costs to manufacture and assemble the table. These complex designs may also result in tables that are relatively difficult to use.

Another type of known table is a traditional card table in which each leg is pivotally connected to the table top by a brace and each leg individually folds against the table top. Known tables may attempt to reduce the inconvenience of individually folding legs against the table top by coupling two of the legs together by a long connecting rod. This may increase the stability of the table top and enable the user to simultaneously fold two legs into the collapsed position. The connecting rods, however, increase the cost of the table, reduce space under the table top, and may easily break or become disconnected.

Conventional tables may also detachably connect the legs to the table top to allow the user to more easily collapse, move and store the table. Disadvantageously, the detachable legs often create a table that is not sturdy or stable. Additionally, moving a table with this type of attachment when the legs are still attached is often difficult because the legs may undesirably detach. These known types of table may include an attachment that mechanically secures the leg to the table top. These mechanical attachments, such as plastic or metal clips or brackets, often break or are otherwise damaged. Further, attachment of these devices to the table top may structurally weaken the table top, which may allow the table to unexpectedly fail. Further, attaching the four separate attachment mechanisms to the table top by fasteners such as screws or bolts may undesirably weaken the table top.

Many conventional tables include four legs in order to support the table top above a surface such as the floor. The four separate legs, however, increase the weight of the table. In additional, the four legs require four separate attachment mechanisms to attach the legs to the table top, which increases the cost and complexity of the table.

BRIEF SUMMARY OF THE INVENTION

A need exists for a table that eliminates the above-described disadvantages and problems.

One aspect of the present invention is a relatively small-sized table that is designed for use by a single person. This type of table that is intended for use by an individual is referred to as a personal table, but it will be appreciated that more than one person could use the table if desired. Advantageously, the personal table is relatively small and light-weight, which makes the table easy to move and transport. Significantly, because the table is sized and configured for personal use, it does not take up unnecessary space or provide a large amount of unused space. Therefore, the personal table provides ample space for a single user without requiring a large area or wasting unnecessary space.

Another aspect of the personal table is it can be used for a wide variety of different situations and uses such as a table for supporting a television, computer, sewing machine, microwave, lamp, luggage, and the like. The table can also be used for a wide variety of other uses such as a bedside table, coffee table, night stand, desk, shop table, and the like. Further, the table can be used while performing a wide variety of tasks such as reading, writing, studying, working, etc. Thus, the personal table can be used in a number of different environments and it can perform numerous different tasks.

Yet another aspect of the personal table is the height of the table can be readily adjusted. Advantageously, the adjustable height table allows it to be used for many different purposes, such as those discussed above.

A further aspect of the personal table is the table top is support by a single pair of legs. The legs are preferably pivotally connected and the legs preferably allow the height of the table top to be easily adjusted. Significantly, because the table top is support by a single pair of legs, that provides additional leg room and/or storage room under the table. In addition, the single pair of legs is light-weight and easily attached to the table top. The single pair of legs can desirably support the table top and suitable objects placed on the personal table. Advantageously, because the personal table has a relatively small size, the single pair of legs can properly support the table.

A still further aspect of the personal table is the legs are preferably movable between a use position and a storage position. The legs preferably extend outwardly from the table top in the use position and the legs support the table top above a surface such as the floor. In the storage position, the legs are preferably collapsed into a relatively compact area, which allows the table to be easily transported or stored. The legs, for example, may be placed adjacent and/or proximate to the bottom surface of the table top in the collapsed position.

Another aspect of the personal table is the table top is preferably constructed from a lightweight material so that the table is easily portable and can be readily lifted and moved by a single person. Desirably, the table top is constructed from blow-molded plastic, such as high density polyethylene. The blow-molded plastic table top provides a rigid, high-strength structure that is capable of withstanding repeated use and wear. Advantageously, the blow-molded table top can be easily manufactured and formed into the desired size and shape. In addition, the blow-molded table top can form a structural component of the table to minimize the number of components and size of the table. Thus, frames, braces or other support members are not required to support the table top.

Yet another aspect of the personal table is the legs can be attached to recesses and/or grooves formed in the table top. In particular, the legs are preferably attached to the table top by a snap, interference or friction fit. This connection of the legs to the table top may also allow the legs to be selectively removed or detached from the table top. Advantageously, because the legs do not require any fasteners or other structures to be connected to the table top, no stress points or other types of weakness are formed in the table top. Thus, the strength and rigidity of the table top is not decreased by forming holes or inserting fasteners into the table top. The legs may also be pivotally or slidably attached to the table top.

One aspect of the personal table is both legs may be removably attached to the table top. This allows the legs to be easily removed for transportation and/or storage. In addition, the removal of both legs may allow the height of the table to be easily adjusted by attaching the legs to different grooves or recess in the table top. One of the legs, however, may be permanently or more securely attached to the table top, and the other leg may be more easily attached or detached from the table top. Thus, the selectively detachable leg may be detached from the table top when the height of the a table is desired to be adjusted and/or the table is desired to be moved or stored. Of course, both of the legs may be easily detached from the table top, but only one of the legs may be detached to allow, for example, the height of the table to be adjusted or to move the legs into a collapsed position.

A further aspect of the personal table is the pair of legs are preferably pivotally connected by a pin, bolt or screw into a generally X-shaped configuration. The pivotal connection advantageously allows the legs to be quickly moved between the storage and use positions. The pivotal connection also allows the height of the table to be readily adjusted. Desirably, each leg includes a lower portion that contacts a support surface such as the floor, a body portion, and an upper portion that is sized and configured to be connected to the table top. The body portion of each of the legs may include two support members, which helps prevent twisting or undesirable torque on the connection of the upper and lower portions to the elongated body portion.

Another aspect of the personal table is the legs can be attached to the table top via double hinge members. Advantageously, the legs can be pivotally attached by the double hinge members to the table top to allow the height of the table top to be adjusted. In particular, the double hinge members are preferably movable between different positions and that allows the height of the table top to be changed. The legs can also be slidably attached to the table top and a ratchet assembly may be used to selectively adjust the height of the table top.

A further aspect of the personal table is the legs are preferably offset towards one side of the table top. Advantageously, because the legs are not placed in the center of the table, that provides enhanced legroom for the user. This also allows the table top to be positioned closer to the body of the user, which may be more convenient for the user.

Advantageously, the personal table is relatively simple to manufacture because it preferably consists of a table top constructed from blow-molded plastic and a pair of pivotally interconnected legs. The blow-molded table top includes two opposing walls that are spaced apart, which increase the strength and rigidity of the table top. The blow-molded table top may also include one or more depressions or tack-offs to further increase the strength of the table top and/or interconnect the spaced apart walls. Significantly, a blow-molded table top is light-weight, durable, generally weather resistant and temperature insensitive, and it does not corrode, rust or otherwise deteriorate. The blow-molded table top can also be formed in various shapes, sizes, configurations and designs.

Additionally, the personal table is easy to assemble, which reduces manufacturing and labor costs. Further, the consumer can easily assemble the personal table and the consumer will appreciate many of the aspects of the personal table such as the light-weight, easy height adjustment, portability, sturdiness, and wide variety of uses in any different environments.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

The present invention is directed towards a table and, in particular, to a table that is intended to be used by a single user at one time. The principles of the present invention, however, are not limited to a table intended for use by an individual user. It will be understood that, in light of the present disclosure, the table can be used by more than one user at any given time.

Additionally, to assist in the description of the table, words such as top, bottom, front, rear, right and left are used to describe the accompanying figures. It will be appreciated, however, that the table can be located in a variety of desired positions—including various angles, sideways and even upside down. A detailed description of the table now follows.

Figure 1:
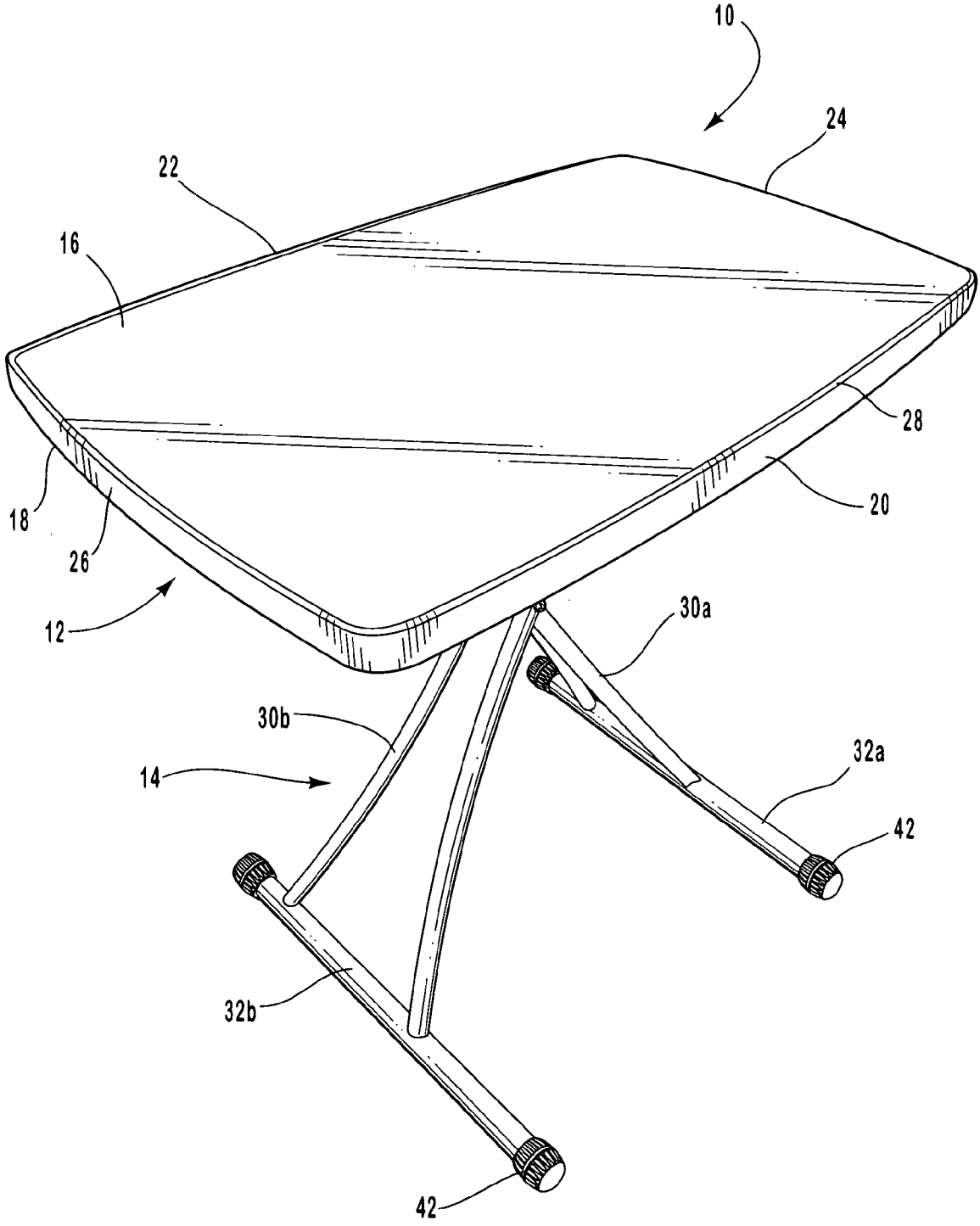
FIG. 1 is a front perspective view of a personal table in accordance with a preferred embodiment of the present invention.

As seen in FIG. 1, an exemplary table 10 is shown. The table 10 is preferably a relatively small-sized table that is intended for use by a single person at one time. Advantageously, because the table 10 is sized and configured for personal use, it does not require a large amount of space. Therefore, the table 10 provides ample space for a single user without requiring a large area or unnecessary space. This table 10 that is sized and configured for use by a single person is referred to as a personal table.

The personal table 10 includes a table top 12 and a support assembly 14 that is used to support the table top above a surface such as the floor or ground. The table top 12 includes a top surface 16, a bottom surface 18, a front side 20, a rear side 22, a right side 24 and a left side 26. The table top 12 may also include a beveled, sloped or rounded surface 28 disposed between the top surface 16 and one or more of the sides 20, 22, 24 and 26. The beveled surface 28 may increase the comfort and safety of the user. The beveled surface 28, for example, may be larger along the front surface 20 of the table top 12, but it will be appreciated that the personal table 10 does not require a beveled surface.

As shown in FIG. 1, the table top 12 preferably has a generally rectangular configuration with rounded corners and slightly rounded outer edges or sides 20, 22, 24, and 26. Desirably, the table top 12 is about thirty (30) inches in length and about twenty (20) inches in width, but one skilled in the art will appreciate that the table top can have other suitable sizes and configurations. For example, the table top 12 may be larger or smaller and the table top can have other configurations such as square, circular, oval, and the like depending, for example, upon the intended use of the personal table 10. In addition, the corners and edges of the table top 12 do not have to rounded and, in contrast, the corners and edges could have any desirable configuration, but the rounded features may increase the comfort and/or safety of the user.

Advantageously, the personal table 10 can be used for a wide variety of purposes and in a number of different environments. For instance, the personal table 10 can be used as a television stand, computer table, sewing table, bedside table, coffee table, microwave stand, desk, shop table, luggage stand and the like. In addition, the personal table 10 can be used for working, reading, writing and other suitable uses. Accordingly, the personal table 10 is capable of many different uses and it is preferably sized and configured to be used by a single person at one time. The personal table 10, as discussed in more detail below, is preferably sized and configured to support one or more objects related to these different tasks and uses. For example, the personal table 10 is desirably configured to support a television, computer, books, or luggage according to its intended use by the individual user.

The table top 12 is preferably constructed from a lightweight material and, more preferably, the table top is constructed from plastic, such as high density polyethylene. The plastic table top 12 is desirably formed by a blow-molding process because, for example, it allows a strong, lightweight, rigid and sturdy table top to be quickly and easily manufactured. Advantageously, the blow-molded plastic table top 12 is lighter weight that conventional table tops constructed from wood or metal, and the blow-molded plastic table top can be constructed from less plastic, which saves manufacturing costs and reduces consumer costs. In particular, the blow-molded table top 12 can be manufactured with thin plastic walls and that allows the table top to cool faster during the manufacturing process, which decreases the manufacturing time. Further, the blow-molded plastic table top 12 can be constructed with any suitable configuration, shape, size, design and/or color depending, for example, upon the intended use of the personal table 10. For example, the table top 12 can be constructed with a generally rectangular configuration of about eighteen by about twenty-four inches (18×24), a table top with a generally circular configuration with a diameter of about twenty inches (20) or a table top with a generally square configuration with twenty-four inch (24) sides may be easily formed during the blow-molding process. Of course, it will be appreciated that the blow-molded table top 12 can have any suitable size and configuration depending, for example, upon the intended use of the personal table 10.

The table top 12 is preferably constructed from blow-molded plastic because blow-molded plastic table tops are durable, weather resistant, generally temperature insensitive, corrosion resistant, rust resistant, and generally do not deteriorate over time. One skilled in the art, however, will appreciate that the table top 12 does not have to be constructed from blow-molded plastic and other suitable materials and/or processes can be used to construct the table top depending, for example, upon the intended use of the personal table 10.

As shown in FIG. 1, the top surface 16 and the bottom surface 18 of the table top 12 are spaced apart a given distance and these two spaced apart surfaces help create a rigid and strong table top 12. Additionally, as described in more detail below, the top and bottom surfaces 16, 18 may be interconnected by one or more depressions or other reinforcement structures and these structures may be sized and configured to further increase the strength and rigidity of the table top 12. Advantageously, these depressions and/or other reinforcement structures can be integrally formed as part of a one-piece structure during the blow-molding process.

The support assembly 14 is used to support the table top 12 above a surface such as the ground or floor. As shown in FIGS. 1–6, an exemplary embodiment of the support assembly 14 includes a first leg 30*a* and a second leg 30*b*. The first leg 30*a* and the second leg 30*b* preferably each include a lower portion 32*a*, 32*b* that is sized and configured to contact the ground or floor, a body portion 34*a*, 34*b*, and an upper portion 36*a*, 36*b*, respectively. The lower portion 32*a*, 32*b* of each of the legs 30*a*, 30*b* is preferably sized and configured to contact the ground or floor. Desirably, the lower portion 32*a*, 32*b* is an elongated member that has a length slightly less than the width of the table top 12 to provide a relatively stable base, but the elongated member could be longer or shorter. As shown in the accompanying figures, the lower portions 32*a*, 32*b* are preferably hollow tubes that are lightweight and easy to manufacture, and the tubes are preferably constructed from metal but any suitable materials may be used. End caps 42 may be attached to the ends of the lower portions 32*a*, 32*b* to prevent foreign objects from entering the hollow tubes and the end caps may provide a non-skid and non-marking surface. It will be understood, however, that neither the lower portions 32*a*, 32*b* or end caps 42 are required.

As shown in FIGS. 1–6, the lower portions 32*a*, 32*b* are preferably positioned generally parallel to each other to provide a stable base for the personal table 10 that is resistant to tipping. It will be appreciated, however, that the lower portions 32*a*, 32*b* could have any desirable size, configuration or design depending, for example, upon the intended use of the personal table 10. For example, the lower portions 32*a*, 32*b* could have a triangular, square, rectangle, generally planar or other suitable configuration, and the support members could have any suitable width and length depending, for example, upon the intended use of the table 10.

The body portions 34*a*, 34*b* of the legs 30*a*, 30*b* preferably consist of one or more elongated members that are used to support the table top 12 above a surface such as the ground or floor. It will be appreciated that the lengths of the body portions 34*a*, 34*b* of the legs 30*a*, 30*b* are preferably the same so that the table top 12 is supported in a generally horizontal position relative to the support surface and the length of the body portions may help determine the overall height of the table 10. The body portions 34*a*, 34*b* of each leg 30*a*, 30*b* are preferably constructed from generally hollow members, such as hollow metal tubes, which are lightweight and easy to manufacture, but the body portions may have any desired sizes and/or configurations. The ends of the body portions 34*a*, 34*b* are preferably securely connected to the lower portions 32*a*, 32*b* of the legs 30*a*, 30*b* by welding or other suitable means.

As shown in FIGS. 1–6, the body portions 34*a*, 34*b* of the legs 30*a*, 30*b* may include two separate elongated support members 40*a*, 40*b*. Alternatively, as shown in FIG. 7, for example, the body portions 34*a*, 34*b* may include only a single elongated support member 40*a*, 40*b*. Advantageously, the body portions 34*a*, 34*b* constructed with two separate elongated support members 40*a*, 40*b* may help prevent twisting or torque on the connection of the body portions 34*a*, 34*b* to the lower portions 32*a*, 32*b*. Additionally, the two separate elongated support members 40*a*, 40*b* of the body portions 34*a*, 34*b* may be curved or spaced apart. In particular, the upper and lower portions of the body portions 34*a*, 34*b* may be spaced apart to facilitate connection of the body portions to the lower portion 32*a*, 32*b*, which may create a more secure connection.

Figure 5:
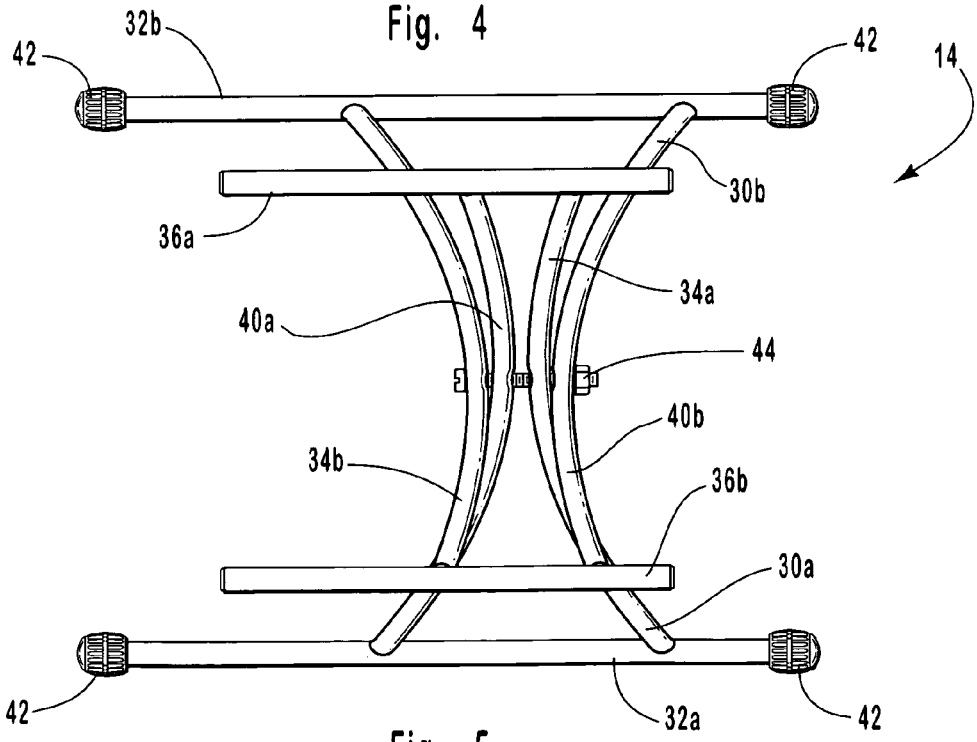
FIG. 5 is a top view of the support legs shown in FIG. 3.
Figure 6:
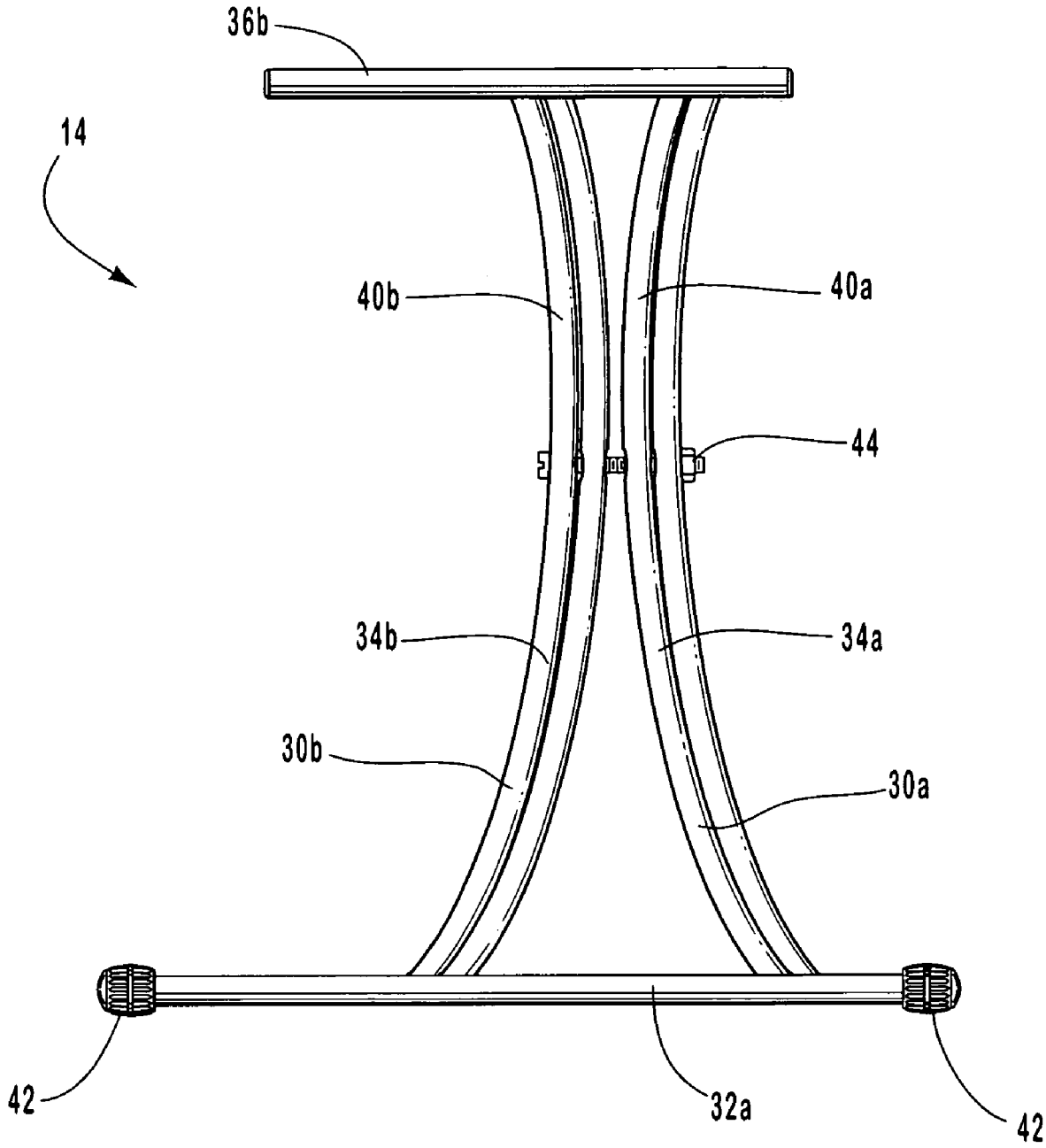
FIG. 6 is a right side view of the support legs shown in FIG. 3.
Figure 7:
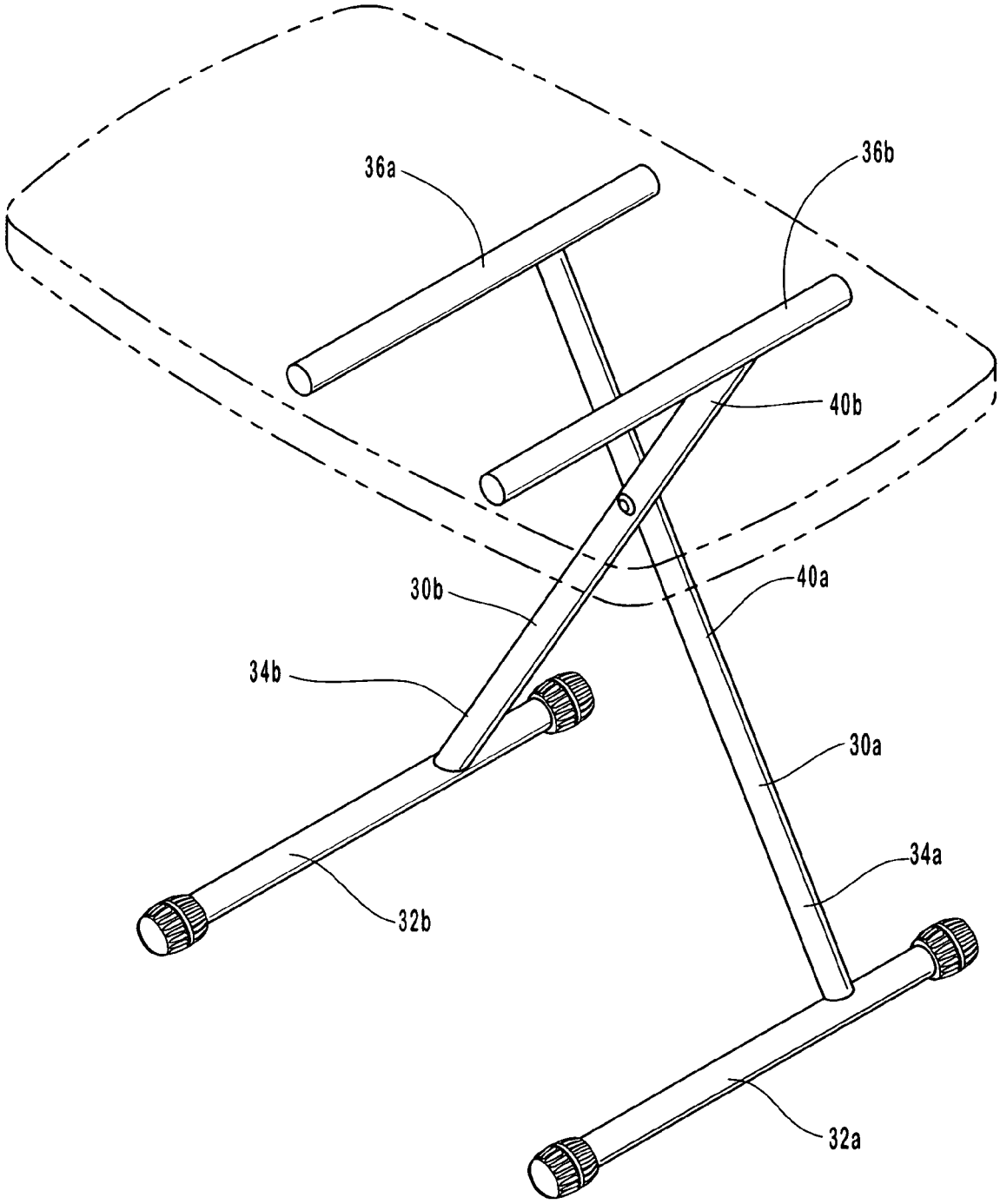
FIG. 7 is a front perspective view of a personal table in accordance with another preferred embodiment of the present invention, illustrating the body portion of the support legs with a single support member.
Figure 8:
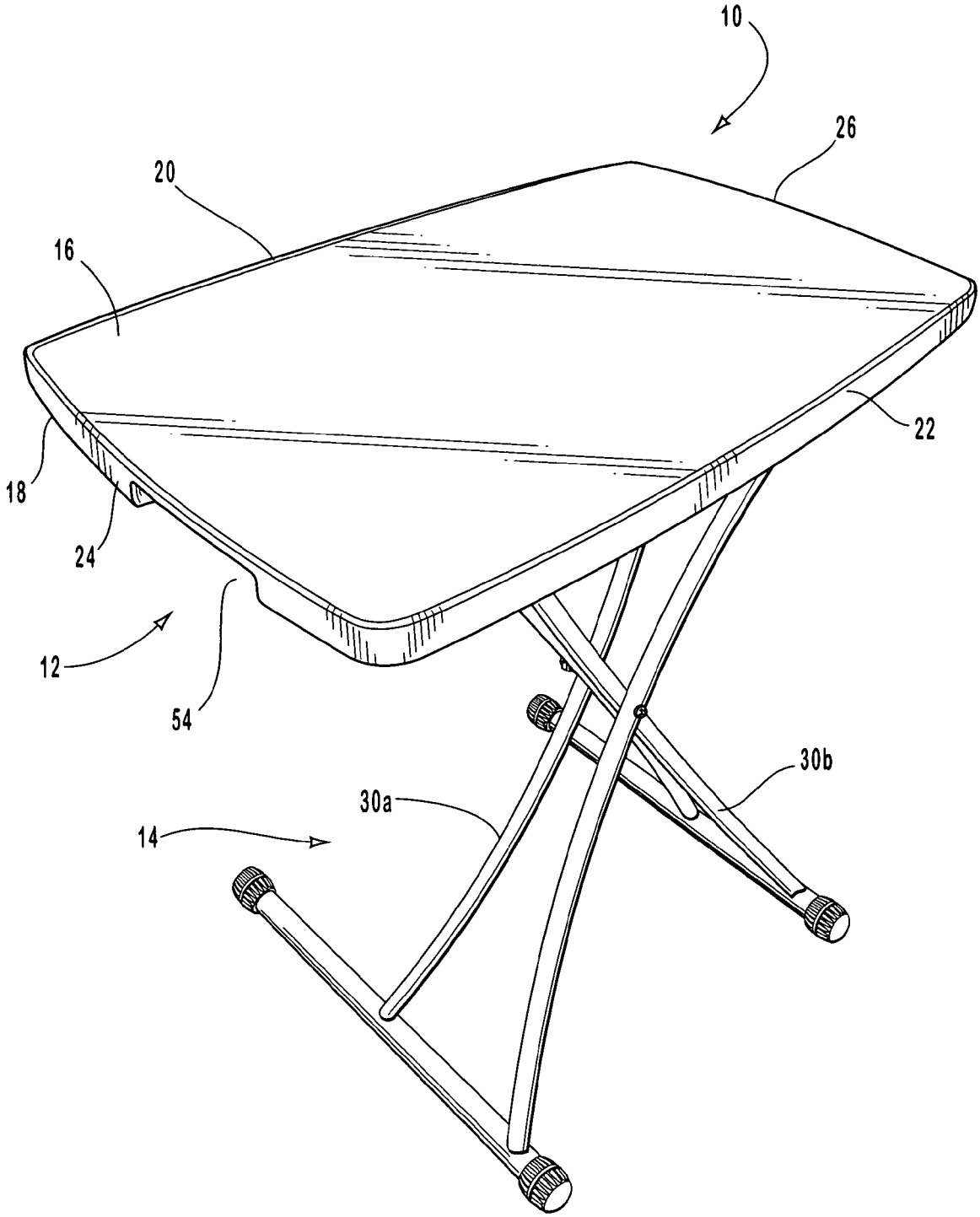
FIG. 8 is a rear perspective view of a personal table in accordance with yet another preferred embodiment of the present invention.
Figure 9:
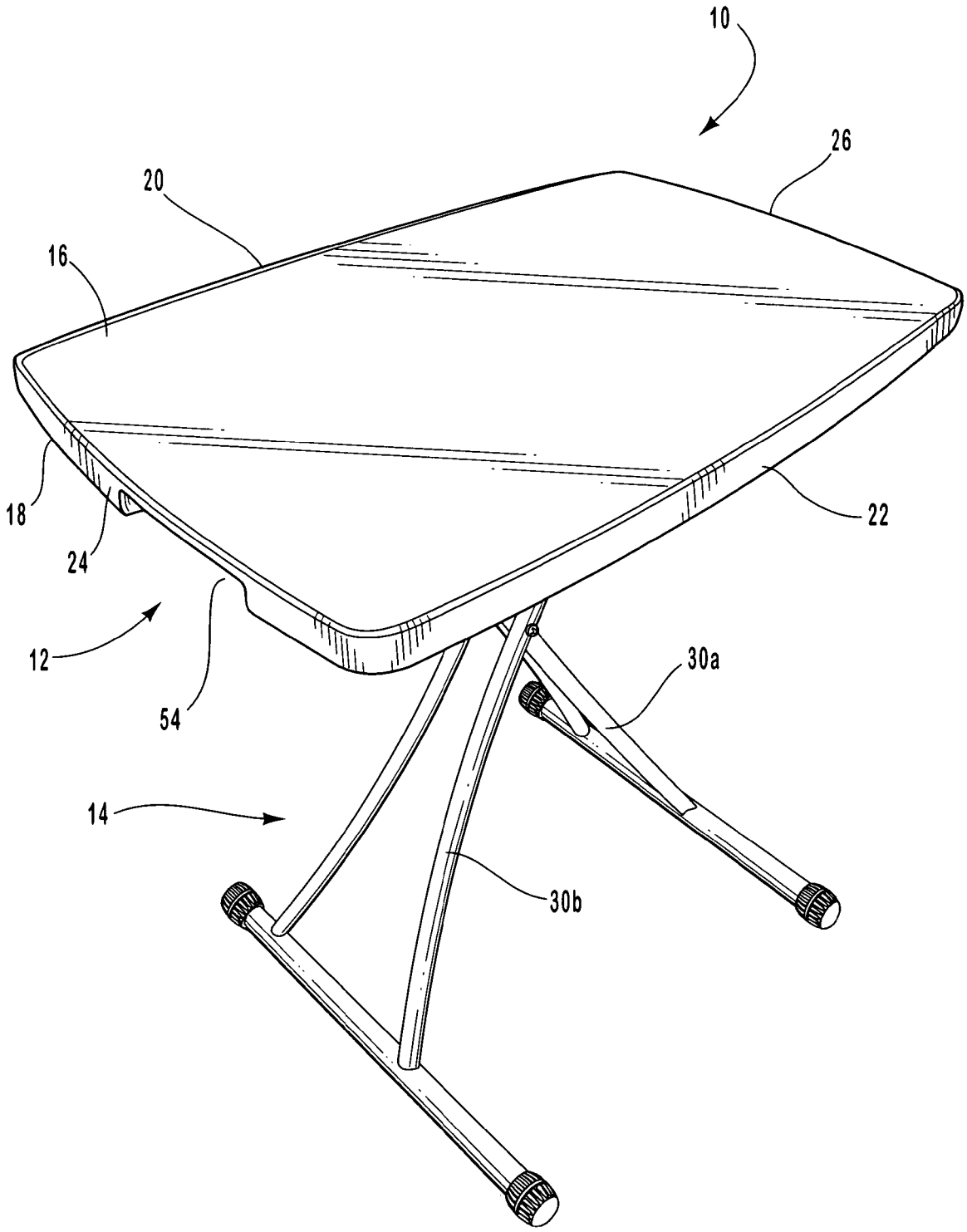
FIG. 9 is a rear perspective view of the personal table shown in FIG. 8, illustrating the support legs in a reversed position.
Figure 11:
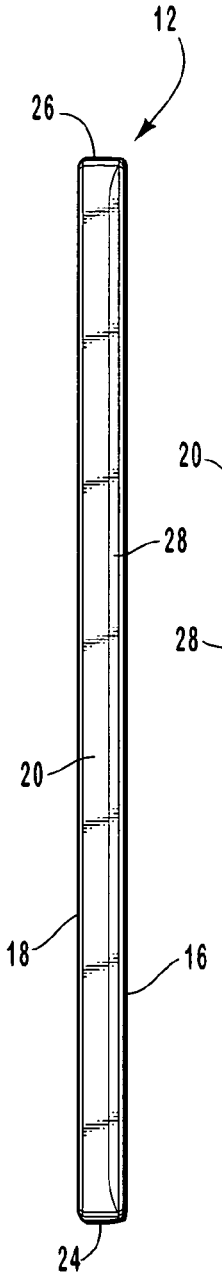
FIG. 11 is a front view of the portion of the personal table shown in FIG. 10.
Figure 10:
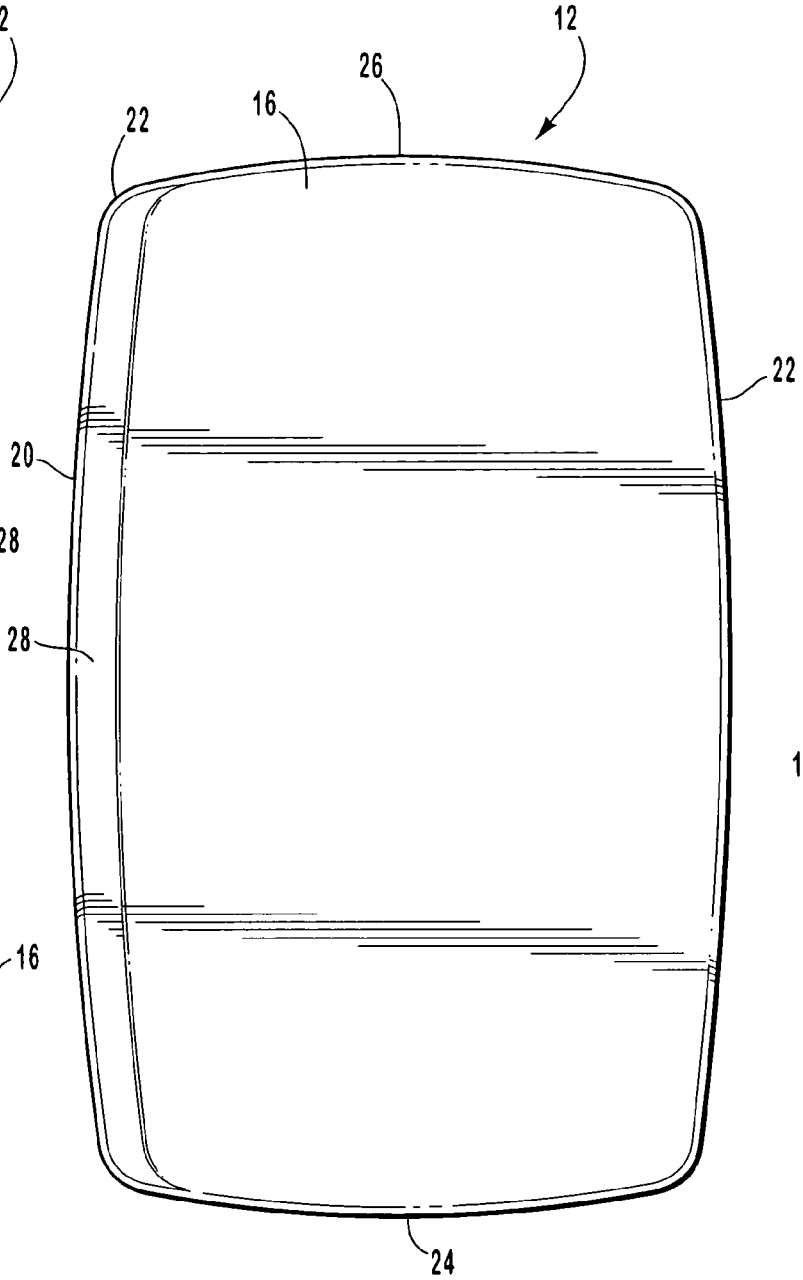
FIG. 10 is a top view of a potion of the personal table shown in FIG. 1, illustrating the table top.
Figure 12:
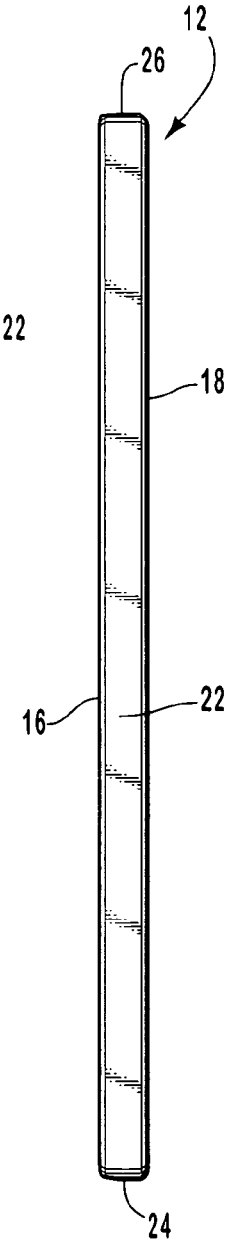
FIG. 12 is a rear view of the portion of the personal table shown in FIG. 10.

As best seen in FIGS. 5 and 6, the upper and lower portions of the body portions 34*a*, 34*b* are preferably curved outwardly and away from each other. The middle portions of the body portions 34*a*, 34*b* are preferably curved or arched towards each other to allow the body portions to be connected. Desirably, the body portions 34*a*, 34*b* are pivotally connected to allow the legs 30*a*, 30*b* to move relative to each other. The legs 30*a*, 30*b* are connected at a connection point by a connector such as a bolt, pin, screw or other type of suitable fastener 44. Desirably, the legs are curved together towards the connection point to decrease the length of the fastener 44 and the connection point is disposed closer to the table top 12 than the lower portions 32*a*, 32*b* of the legs 30*a*, 30*b*, but the legs may be connected at any desired point. It will be appreciated that the legs 30*a*, 30*b* may also be slidably or otherwise movably attached.

Figure 3:
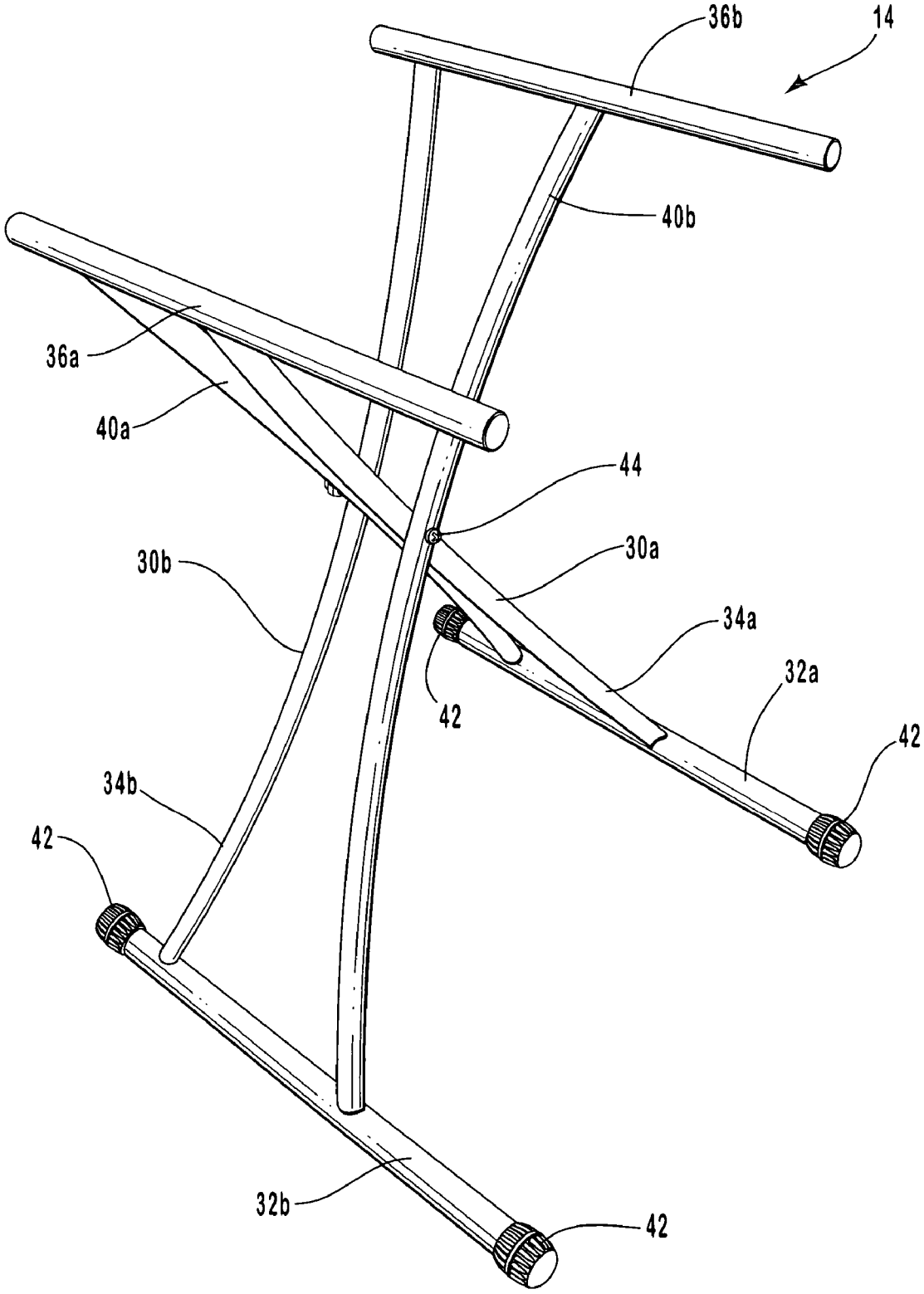
FIG. 3 is a front perspective view of a portion of the personal table shown in FIG. 1, illustrating the support legs in an extended position.
Figure 4:
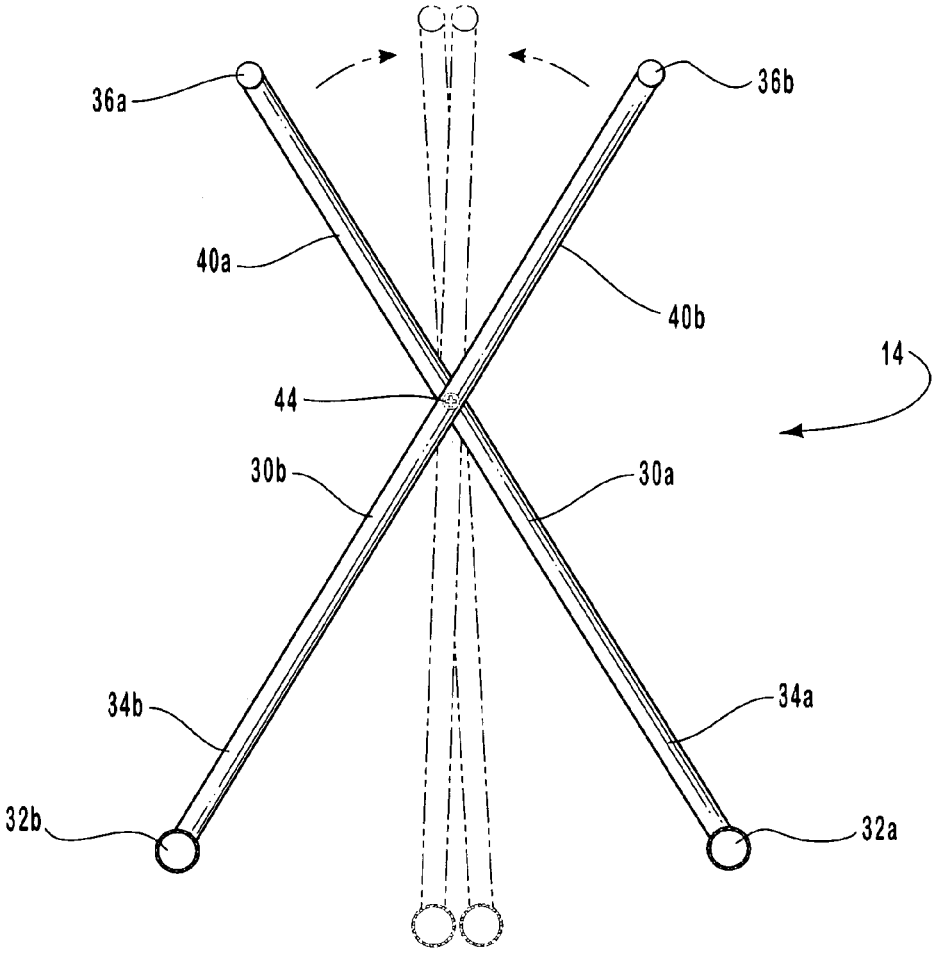
FIG. 4 is a front view of the support legs shown in FIG. 3, illustrating the legs in an extended position and a collapsed position.

As seen in FIGS. 3–6, for example, the upper portions 36*a*, 36*b* are attached to the upper portions of the body portions 34*a*, 34*b*. The upper portions 36*a*, 36*b* preferably have generally the same size and size, and the upper portions are desirably constructed from hollow metal tubes. The hollow tubes preferably have a generally circular configuration, but the tubes may also be oval, oblong, square, rectangular or have other suitable configurations. The upper portions 36*a*, 36*b*, however, do not have to be constructed from hollow metal tubes and the upper portions may also be constructed from other suitable components and materials. As best seen in FIGS. 3–5, the upper portions 36*a*, 36*b* are preferably spaced closer together than the lower portions 32*a*, 32*b* when the legs are in an expended position.

Figure 13:
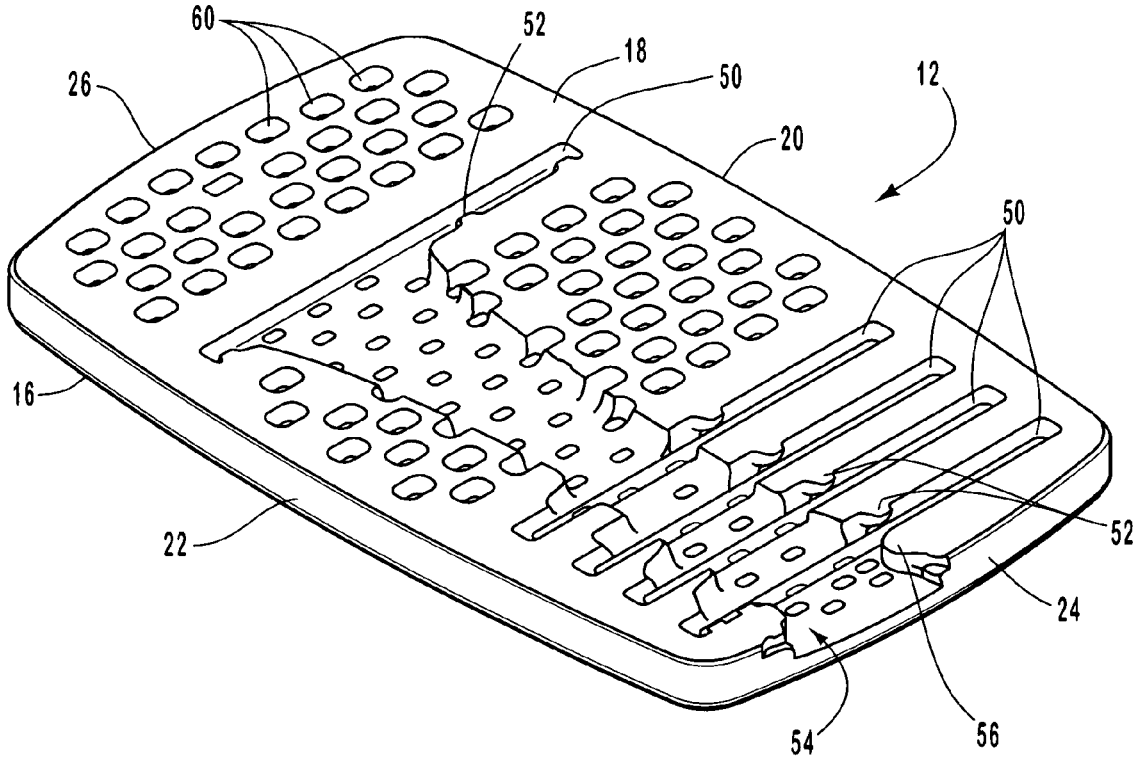
FIG. 13 is a bottom perspective view of the portion of the personal table shown in FIG. 10.
Figure 14:
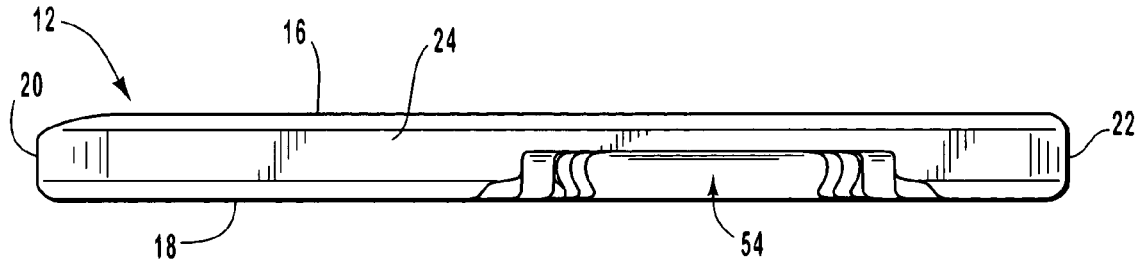
FIG. 14 is right side view of the portion of the personal table shown in FIG. 10.
Figure 15:
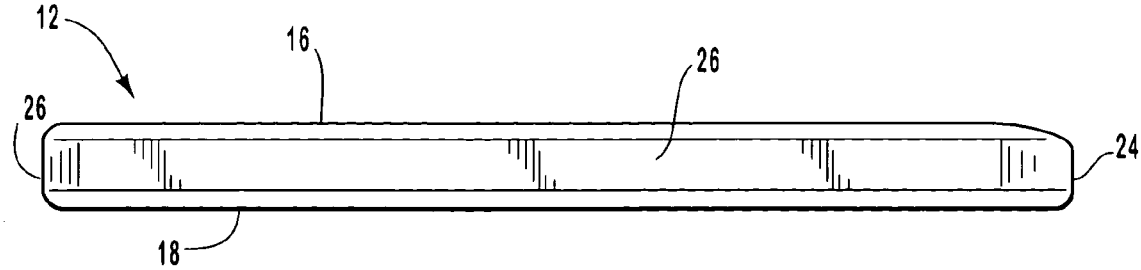
FIG. 15 is a left side view of the portion of the personal table shown in FIG. 10.

The upper portions 36*a*, 36*b* of the legs 30*a*, 30*b* are preferably sized and configured to be received within leg receiving recesses formed within the table top 12. Advantageously, if the upper portions 36*a*, 36*b* have the same size and configuration, then the upper portions may be interchangeably attached to the table top 12. For example, as seen in FIG. 13, the bottom surface 18 of the table top 12 may include one or more leg receiving recesses 50 that are sized and configured to receive the upper portions 36*a*, 36*b* of the legs 30*a*, 30*b*. Preferably, the upper portions 36*a*, 36*b* are configured to be connected to selected leg receiving recesses by a snap fit, friction or interference fit, which allows the legs 30*a*, 30*b* to be quickly and easily attached and detached from the table top 12, but the legs can be connected to the table top 12 by any suitable manner. Further, latches, tabs, locking members, clips fasteners or other suitable devices may be used to retain the upper portions 36*a*, 36*b* in the leg receiving recesses.

The leg receiving recesses 50 preferably generally extend from the front edge to the rear edge of the table top 12, but the leg receiving recesses may be formed in any desired portion of the table top and have any desired size and configuration depending, for example, upon the size and shape of the upper portions 36*a*, 36*b* of the legs 30*a*, 30*b*. The leg receiving recesses 50 preferably extend only a portion of the distance between the bottom 18 surface and the top surface 16, but the upper portion of the leg receiving recess may contact or engage the top surface of the table top.

Advantageously, the leg receiving recesses 50 formed in the table top 12 allow the table 10 to be constructed without a frame, which reduces manufacturing costs. Additionally, the engagement between leg receiving recesses 50 and the legs 30*a*, 30*b* creates a stable support assembly 14. One skilled in the art will understand that the support assembly 14 can be connected to the table top 12 by other suitable means such as adhesives or mechanical fasteners.

The leg receiving recesses may also include one or more retaining members 52. The retaining members 52 may flex or bend slightly to allow the upper portions 36*a*, 36*b* of the legs 30*a*, 30*b* to be inserted and removed from the leg receiving recesses. The retaining members 52 preferably resiliently return to their original positions to help secure the upper portions 36*a*, 36*b* of the legs 30*a*, 30*b* within the leg receiving recesses 50. It will be appreciated, however, that the leg receiving recesses 50 may not require the use of the retaining members 52 to hold the upper portions 36*a*, 36*b* of the legs 30*a*, 30*b* within the leg receiving recesses.

In greater detail, the retaining members 52 preferably include a lip that extends over a portion of the leg receiving recess 50 and the lip deforms or deflects to the leg receiving recess. The lip preferably includes a generally hollow interior that is formed during the blow-molding process. In addition, the lip is preferably formed during the blow-molding process as part of an integral, one-piece structure.

Advantageously, because the table top 12 preferably includes a plurality of leg receiving recesses 50 and the legs 30*a*, 30*b* can be connected to any suitable leg receiving recesses, this allows the legs to be connected to different leg receiving recesses. As discussed in greater detail below, this may allow the height of the table 10 to be adjusted.

The legs 30*a*, 30*b* are preferably sized and configured to be quickly and easily connected and/or disconnected to any desired leg receiving recesses 50. In particular, the legs 30*a*, 30*b* are preferably pivotally connected to allow the legs to pivot or scissor back and forth with respect to one another at a wide variety of angles. This pivotal connection allows the legs 30*a*, 30*b* to be quickly and easily positioned so that the legs can be connected to the desired leg receiving recesses 50 in the table top 12. This pivotal connection also allows the legs 30*a*, 30*b* to be moved between a first or extended position, which is shown in solid lines in FIG. 4, and a second or collapsed position, which is shown in broken lines in FIG. 4. The legs 30*a*, 30*b* desirably fold generally flat and/or adjacent to each other in the second or collapsed position to allow the personal table 10 to be easily stored or collapsed.

A channel 54 may be formed in the bottom surface 18 of the table top 12 to receive at least a portion of the legs 30*a*, 30*b* in the collapsed position. As seen in FIGS. 13–18, the channel 54 preferably interconnects two or more of the leg receiving recesses 50 and the channel preferably extends through a side of the table top 12 such as the right side 24. The channel 54 preferably has a shape similar to that of the body portions 34*a*, 34*b* of the legs 30*a*, 30*b* and the channel is preferably sized and configured to receive at least a portion of one or the body portions of the legs in the collapsed position, as shown in FIG. 18. This allows the legs 30*a*, 30*b* to be disposed generally adjacent to the table top 12, which reduces the required amount of storage space and this may also allow the personal tables 10 to be easily stacked.

The legs 30*a*, 30*b* may be retained in the collapsed position in the channel 54 by one or more tabs 56. The tabs 56 are preferably located near an edge of the table top 12 and the tabs are preferably sized and configured to extend over a portion of the channel 54. The one or more tabs 56 deform or deflect to allow the legs 30*a*, 30*b* to be received or removed from the channel 54. The tabs 56 preferably include a generally hollow interior portion and the tabs are desirably formed during the blow-molding process as part of an integral, one-piece structure. One skilled in the art will understand that clips, fasteners and other types of devices may be used to secure the legs 30*a*, 30*b* in the collapsed position.

The pivotal connection of the legs 30*a*, 30*b* and the plurality of leg receiving recesses 50 allows the height of the personal table 10 to be easily adjusted. As described in more detail below, the user can select which leg receiving recesses 50 to receive the legs 30*a*, 30*b* and this allows the desired height to be selected. For example, it will be appreciated that if the legs 30*a*, 30*b* are attached to two leg receiving recesses 50 that are close together, the table 10 will have a given height. However, if the legs 30*a*, 30*b* are attached to two leg receiving recesses 50 that are farther apart, then the table 10 will have a lower height.

The legs 30*a*, 30*b* can desirably be quickly and easily moved between the extended and collapsed positions. For example, if the support legs 30*a*, 30*b* are completely disengaged from table top 12, then the legs 30*a*, 30*b* can be folded into the collapsed position for storage. Alternatively, one or more of the legs 30*a*, 30*b* may be attached to the table top 12 when the legs in the collapsed position. Thus, a variety of different configurations are contemplated when table 10 is collapsed, including: (1) the support assembly 14 is completely disengaged from table top 12; (2) at least a portion of support assembly is connected to the table top while another portion of the support assembly is disconnected from the table top; and (3) at least a portion of support assembly is permanently coupled to table top.

Figure 2:
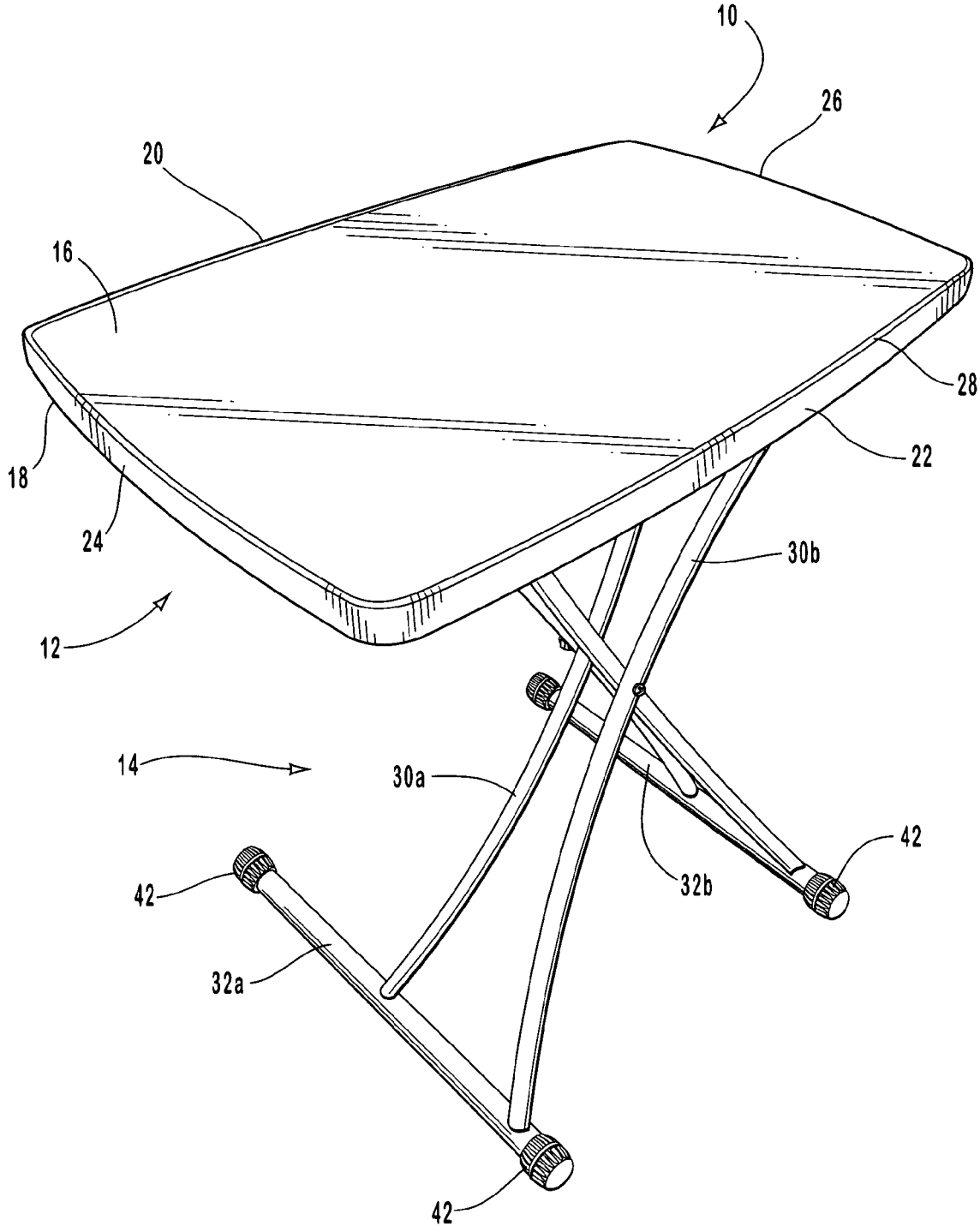
FIG. 2 is a rear perspective view of the personal table shown in FIG. 1.

The support assembly 14 is preferably configured to maximize the legroom for the user when table 10 is in an upright position. For example, as shown in FIGS. 1–3, the body portions 34*a*, 34*b* of legs 30*a*, 30*b* are not centered with the lower portions 32*a*, 32*b* or upper portions 36*a*, 36*b*. Instead, the body portions 34*a*, 34*b* are disposed towards an end of the lower portions 32*a*, 32*b* and upper portions 36*a*, 36. Thus, when the table top 12 is coupled to the support assembly 14, as shown in FIG. 1 for example, the body portions 34*a*, 34*b* are located proximate the rear side 22 of the table top 12. Therefore, when the user is seated at front side 20 of table 10, the body portions 34*a*, 34*b* of the legs 30*a*, 30*b* are positioned farther away from the user so as to avoid impeding the user's space.

In particular, because the body portions 34*a*, 34*b* of the legs 30*a*, 30*b* are positioned near the rear side 22 of table top 12, the user can slide the table 10 closer to their body. This allows the user to position the top surface 16 of the table top 12 in a desired position while still maintaining adequate legroom underneath the table 10. Thus, it can be seen that table 10 facilitates the ergonomic comfort of the user by reducing the need of the user to lean forward over the table in order to perform a particular task, such as reading or crafting. The offset body portions 34*a*, 34*b* also allow the user to slide a chair under the table 10 such that the support assembly 14 does not generally interfere with the chair. It will be appreciated, however, that the body portions 34*a*, 34*b* may be located in any suitable relation to the lower portions 32*a*, 32*b* and/or upper portions 36*a*, 36*b* of the legs 30*a*, 30*b*.

As seen in FIG. 13, for example, a plurality of depressions 60 may be formed in the bottom surface 18 of the table top 12. The depressions 60 are preferably sized and configured to provide additional structural support and integrity to table top 12. The depressions 60 may cover a substantial portion of the bottom surface 18 of the table top 12 or the depressions may cover only a portion of bottom surface of table top. The depressions 60 may also be located in the leg receiving recesses 50 and/or channel 54, if desired. Alternatively, the table top 12 can be constructed without any depressions 60. In addition, while the depressions 60 are preferably located in the bottom surface 18, it will be appreciated that depressions may also be formed in any desired portion of the table top 12.

As shown in FIG. 13, the depressions 60 may be formed in an array. The depressions 60 in the array may be located in a staggered, geometric, random or other suitable pattern. Additionally, the depressions 60 may extend from one surface to an opposing surface such that an end of the depression contacts or engages the opposing surface. The depressions 60 may also extend only a portion of the distance between the opposing surfaces. For example, the depressions 60 may extend from the bottom surface 18 to the top surface 16, but the depressions may also extend only a portion of the distance between the bottom and top surfaces.

The depressions 60 advantageously increase the strength of the table 12. While it was previously believed that stronger structures were provided by making the walls thicker and/or adding structures such as ribbing, the depressions 60 provide the surprising and unexpected result that an increased number of depressions may provide a stronger structure and/or thinner walls may be used to construct the structure. Surprisingly, the depressions 60 increase the structural integrity of the structure despite forming disruptions in the continuity of bottom surface 18, and less plastic can be used to make the structure even though the plurality of depressions 60 are formed in the structure. The costs of manufacturing and transportation may be decreased because thinner plastic walls may be used to construct the table top 12, which may create a lighter weight table 10.

Additionally, when blow-molded structures are formed, a certain amount of time must elapse before the structure can be removed from the mold. Blow-molded structures with thicker walls require a longer cooling time than structures with thinner walls. The depressions 60, however, allow table tops 12 with thinner plastic walls to be constructed and that reduces the cooling time before the structure can be removed from the mold. Significantly, a reduced cycle time increases the efficiency of manufacturing process. In addition, because less plastic is required, the cost of the table 10 may be reduced.

Advantageously, the leg receiving recesses 50, retaining members 52, channels 54, extending tabs 56 and/or depressions 60 may be formed integrally with table top 12 during the blow-molding process as part of a one-piece structure. Advantageously, this allows a strong, lightweight structure to be created. It will be appreciated, however, that these structures do not have to be formed as part of a unitary structure and, in contrast, one or more of these structures can be formed after the blow-molding process.

Figure 16:
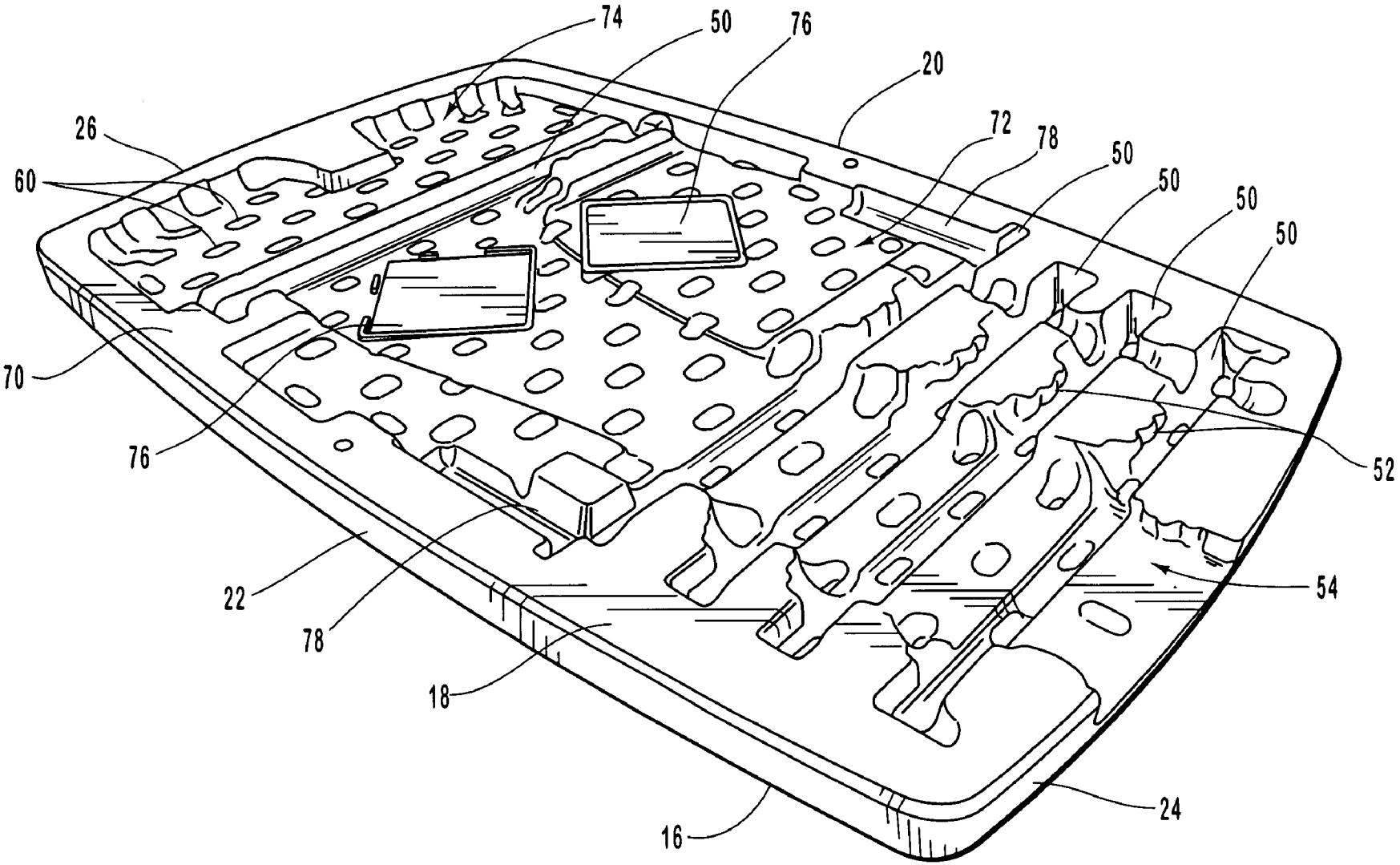
FIG. 16 is a bottom perspective view of a portion of a personal table in accordance with still another preferred embodiment of the present invention.
Figure 17:
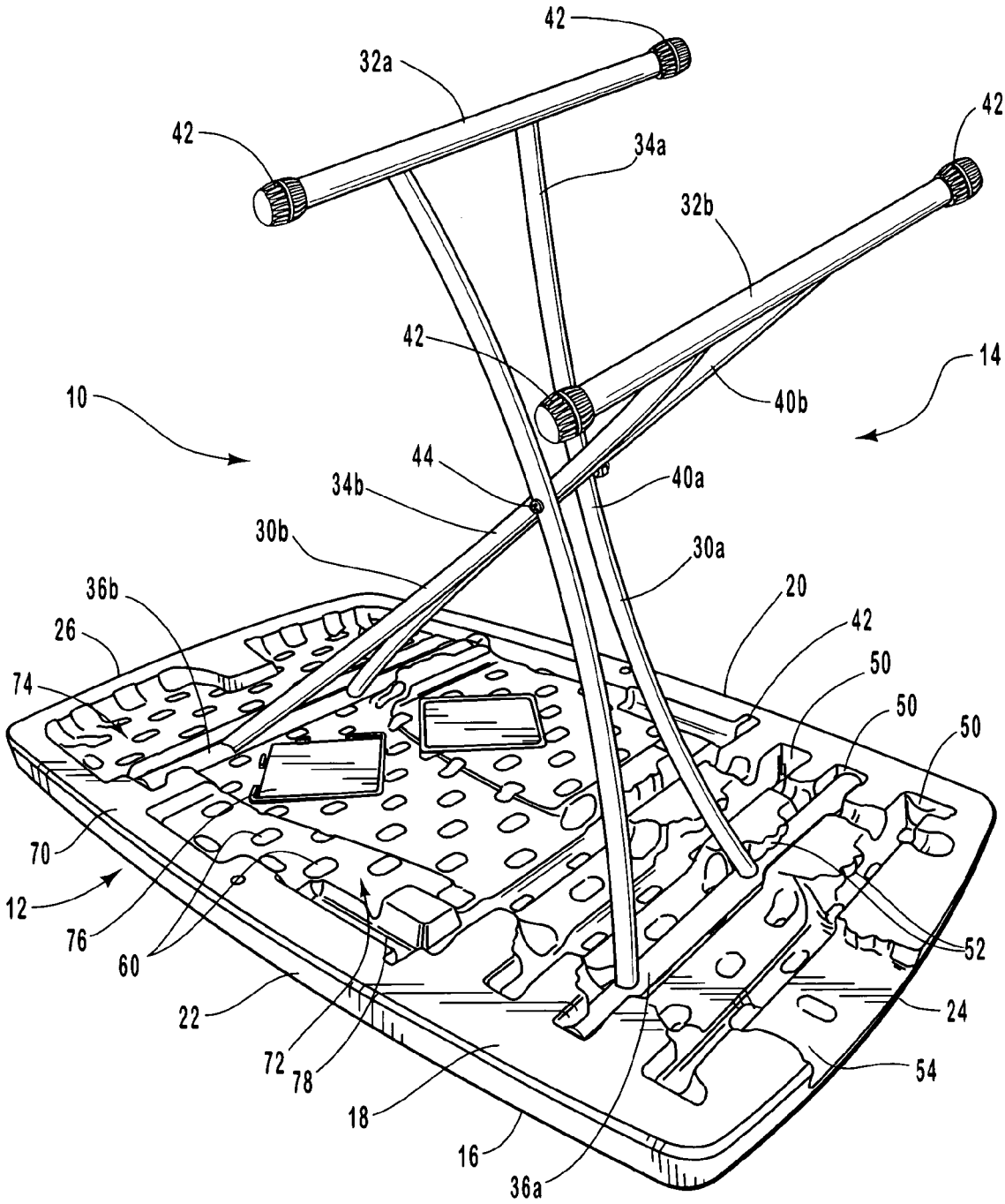
FIG. 17 is a bottom perspective view of the personal table shown in FIG. 16, illustrating the support legs attached to the bottom surface of the table top and in an extended position.
Figure 18:
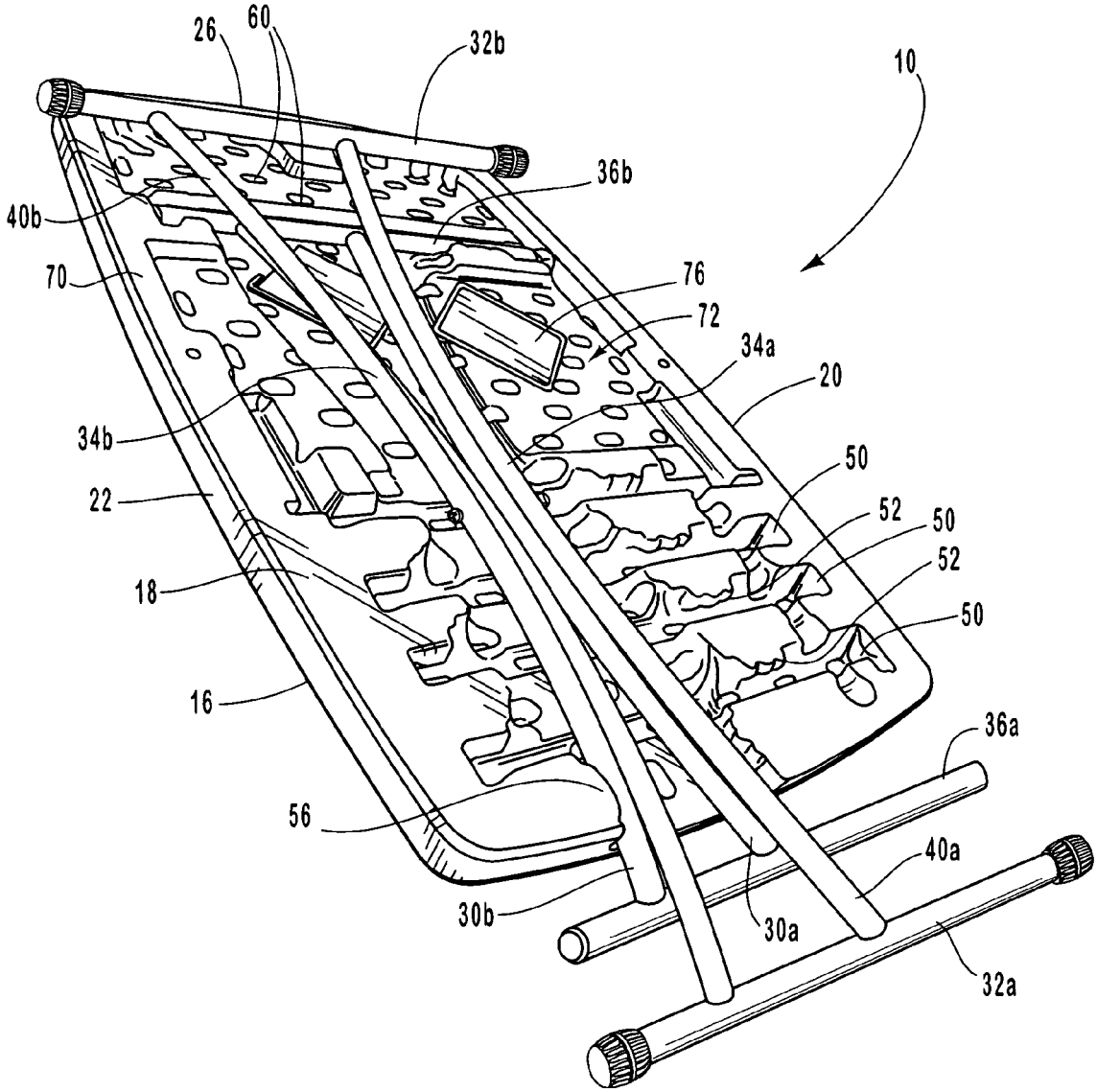
FIG. 18 is a bottom perspective view of the personal table shown in FIG. 16, illustrating the support legs attached to the bottom surface of the table top and in a collapsed position.

The personal table can also have other suitable configurations such as shown in FIGS. 16–18. In particular, the personal table 10 shown in FIGS. 16–18 includes a table top 12 with a plurality of receiving recesses 50 formed in the bottom surface 18 and this allows the support assembly 14 to be connected to the table top. This allows, as seen in FIG. 17 for example, the first leg 30*a* to be connected to one of the receiving recesses 50 disposed near the right side of the table top 12 and the second leg 30*b* to be connected to the receiving recess disposed near the left side of the table top. Advantageously, the first leg 30*a* can be selectively connected to any suitable receiving recess 50 disposed near the right side of the table top 12 in order to allow the height of the table 10 to be adjusted. For example, if the first leg 30*a* is connected to the receiving recess 50 disposed proximate the center of the table top 12, then the table 10 will have a first height such as twenty-eight inches. On the other hand, if the first leg 30*a* is connected to the receiving recess 50 disposed proximate the right side 24, then the table 10 will have a second height such as twenty-one inches. Of course, the first leg 30*a* could also be connected to one of the other receiving recesses 50 to create a table 10 with a height such as twenty-four or twenty-six inches. It will be appreciated that the table 10 could be sized and configured to have any suitable height and the table may include any desired number of receiving recesses 50 to allow the height of the table to be adjusted.

The table top 12 shown in FIGS. 16–18 includes an outer edge 70 and a recessed center section 72. The recessed center section 72 is preferably located between the leg receiving recesses 50 disposed on the right side 24 of the table top 12 and the left side 26 of the table top. The recessed center section 72 may include one or more depressions 60 and the recessed center section preferably extends towards the top surface 16 of the table top 12. The table top 12 may also include one or more recessed outer sections 74 disposed towards the outer edge 70 of the table top. The recessed center section 72 and recessed outer sections 74 may be located in any desired configuration and the leg receiving recesses 50 and/or channel 54 may be located within one or more of these recessed sections.

As best seen in FIGS. 16 and 17, at least a portion of the channel 54 is formed in the recessed center section 72. The channel 54, however, may be flush with the recessed center section 72 if desired. In addition, the table top 12 may include one or more generally planar portions 76 that allow instructions, warnings, safety labels, manufacturer information, operating instructions and other information to be attached to the table top. The table top 12 may also include one or more support grooves 78 or other desired types of reinforcement structures. Desirably, the support grooves 78 may be sized and configured to increase the strength and rigidity of the table top 12.

In order to use the table 10 shown in FIGS. 16–18, one of the legs of the support assembly 14 is inserted into one of the desired leg receiving recesses 50 and the other leg is inserted into another of the desired leg receiving recesses. This allows a personal table 10 with the desired height to be created. In order to adjust the height of the personal table 10, one or both of the legs may be removed from their respective leg receiving recesses 50 and inserted into another desired leg receiving recess. In order to collapse the table 10, the first leg 30*a* is preferably removed from its leg receiving recess 50 and the legs 30*a*, 30*b* are positioned within the channel 54 as shown in FIG. 18. Advantageously, the extending tabs 56 may help hold the legs 30*a*, 30*b* in the collapsed position. When it is desired to use the table 10, the legs 30*a*, 30*b* are removed from the channel 54 and the first leg is inserted into the desired leg receiving recess 50. It will be appreciated that the entire support assembly 14 can be removed if desired or one of the legs may be permanently attached to the table top 12.

It will be appreciated that the leg receiving recesses 50 may also be disposed along the length of table top 12. That is, the leg receiving recesses 50 may be disposed proximate the front side 20 and rear side 22 of the table top 12. Advantageously, this may provide additional uses for the personal table 10. Further, if desired, the leg receiving recesses 50 may be disposed along the length and/or width of the table top 12 depending, for example, upon the intended use of the table 10.

From the foregoing description, the leg receiving recesses 50 allow the personal table 10 to be readily adjusted to various suitable heights. For example, the personal table 10 may be configured to have a maximum height, an intermediate height, and a minimum height. Thus, the table 10 may be configured to have a height that enables a user to stand and utilize the table, a height that is generally equal to the height of a counter top, and/or a height that enables the user to be seated at the table. Additionally, the height of the table 10 may be adjusted according to the desired use of the table. For example, the height of the table may be adjusted to allow the table to be used by children, or the table may have a height which allows it to be used as a television tray or table. Significantly, the various heights of table 10 can be predetermined and designed for any suitable purpose. This provides great flexibility and a wide variety of uses for table 10.

Figure 19:
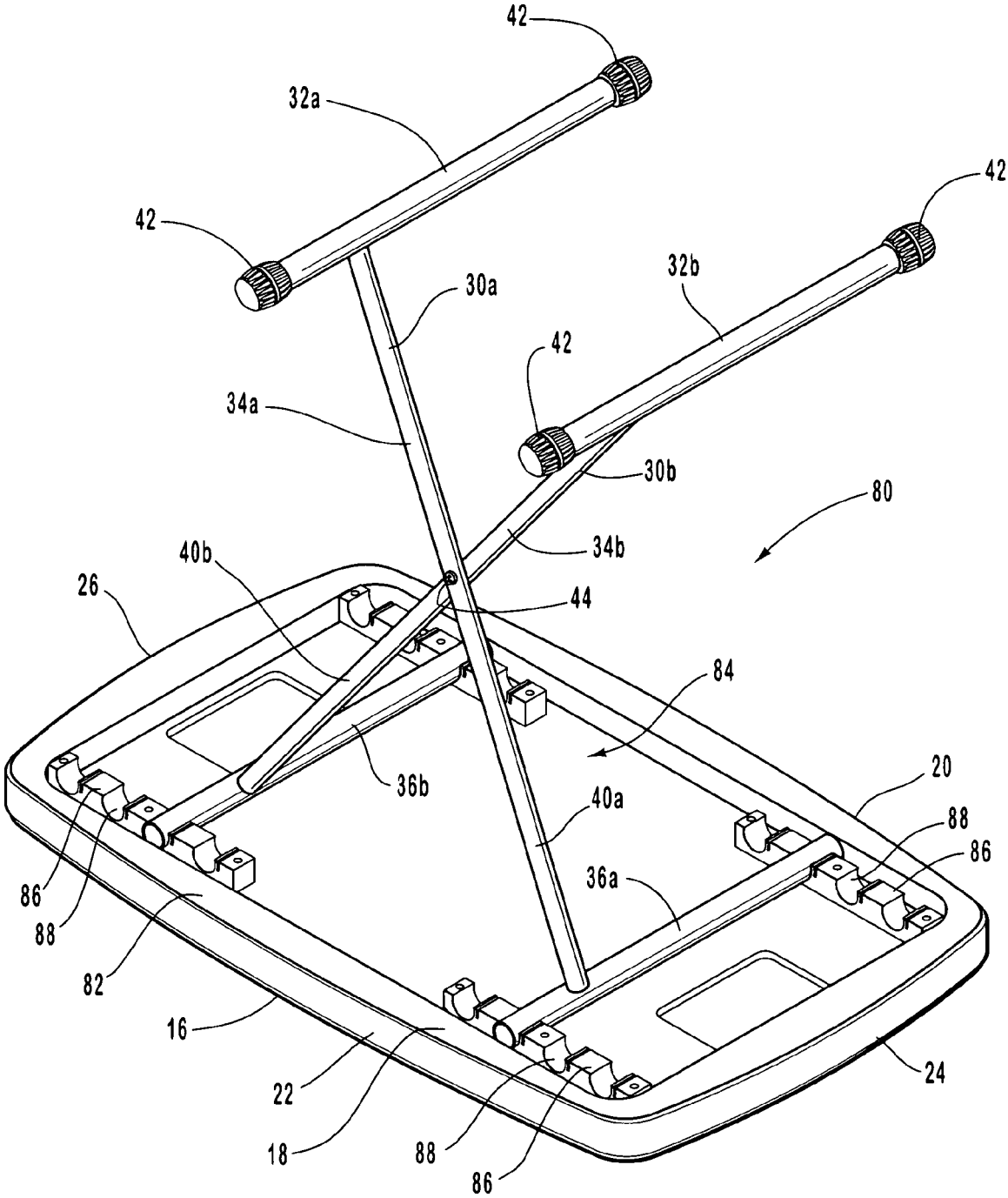
FIG. 19 is a bottom perspective view of a personal table in accordance with another preferred embodiment of the present invention.

FIG. 19 illustrates another aspect of a personal table 80. The personal table 80 includes a table top 12 with an outer wall or lip 82. The outer wall 82 a preferably extends generally downwardly from the bottom surface 18 of the table top 12 and it may form a boarder or edge to the table top. The outer wall 82 preferably encloses a central area 84 in which one or more receiving members 86 are located. Advantageously, the outer wall 82 may help hide parts of the table 80 from the view of the user and it may also help protect the user from unintentionally contacting parts of the table. The receiving members 86 include one or more curved receiving portions 88 that are sized and configured to receive the upper portions 36*a*, 36*b* of the legs 30*a*, 30*b*. The upper portions 36*a*, 36*b* of the legs 30*a*, 30*b* are inserted into the desired receiving portions 88 and the legs are preferably held within the receiving portions by a snap, friction or interference fit. It will be appreciated that the legs 30*a*, 30*b* may be attached to the receiving members 86 by any suitable means such as fasteners, clips, brackets, clasps and the like.

As shown in FIG. 19, the table 80 includes four receiving members 86 that are located proximate the four corners of the table. The receiving members 86 may be integrally formed in the table top 12 during the blow-molding process to form a one-piece structure, or the receiving members may be attached to the table top 12. The receiving members 86 are preferably disposed within the central area 84 so that the receiving members are generally hidden from view by the lip 82. The receiving members 86 are also preferably generally parallel aligned and the receiving members are sized and configured to selectively receive the upper portions 36*a*, 36*b* of the legs 30*a*, 30*b*. It will be understood that the receiving members 86 may be positioned in any desired location and the table top 12 may include other features such as a channel 54 and/or depressions 60.

The receiving members 86 provide a height adjustment mechanism for selectively increasing or decreasing the distance between the upper portions 36*a*, 36*b* of legs 30*a*, 30*b* of the support assembly 14, which allows the height of the table 80 to be adjusted. Advantageously, because the receiving members 86 preferably include a plurality of receiving portions 88, that allows the table to have a plurality of different heights. One skilled in the art will understand that the receiving members 86 may have any suitable number of receiving portions 88 and it is not required that all the receiving members have the same number of receiving portions.

In order to use the table 80, one of the legs 30*a*, 30*b* of the support assembly 14 is inserted into a desired pair of receiving portions 88 in the receiving members 86. The other leg is then inserted into another desired pair of receiving portions 88 in the receiving members 86 to create a personal table 80 with the desired height. In order to adjust the height of the personal table 80, one or both of the legs 30*a*, 30*b* may be removed from their respective receiving portions 88 and inserted into other desired receiving portions. In order to collapse the table 10, one or both of the legs 30*a*, 30*b* are removed from the receiving portions 88 and the legs may be moved into a collapsed position.

Figure 20:
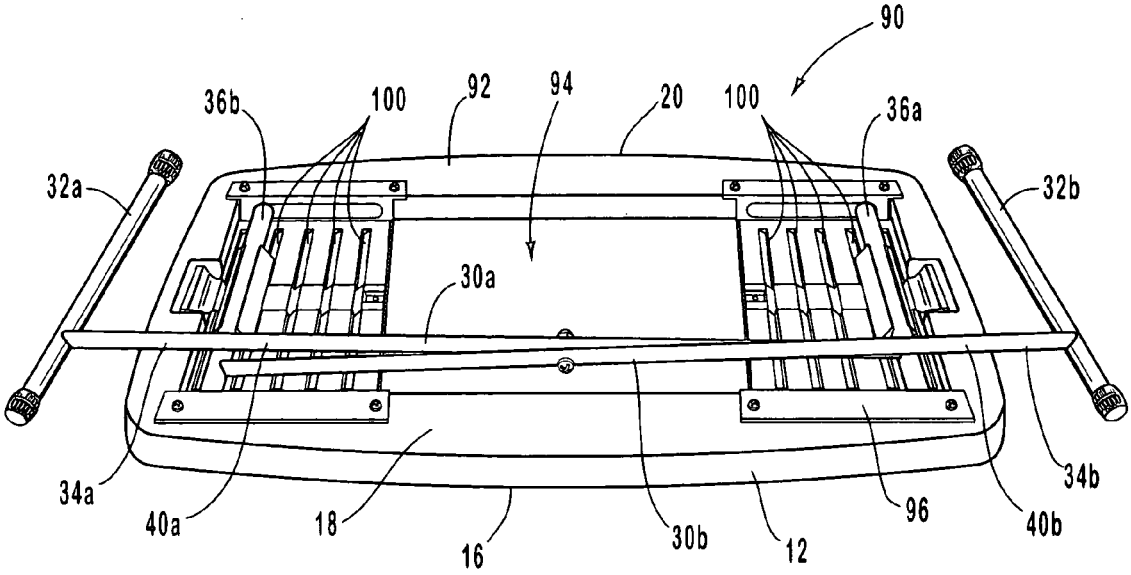
FIG. 20 is a bottom perspective view of a personal table in accordance with yet another preferred embodiment of the present invention, illustrating the support legs in a collapsed position.
Figure 21:
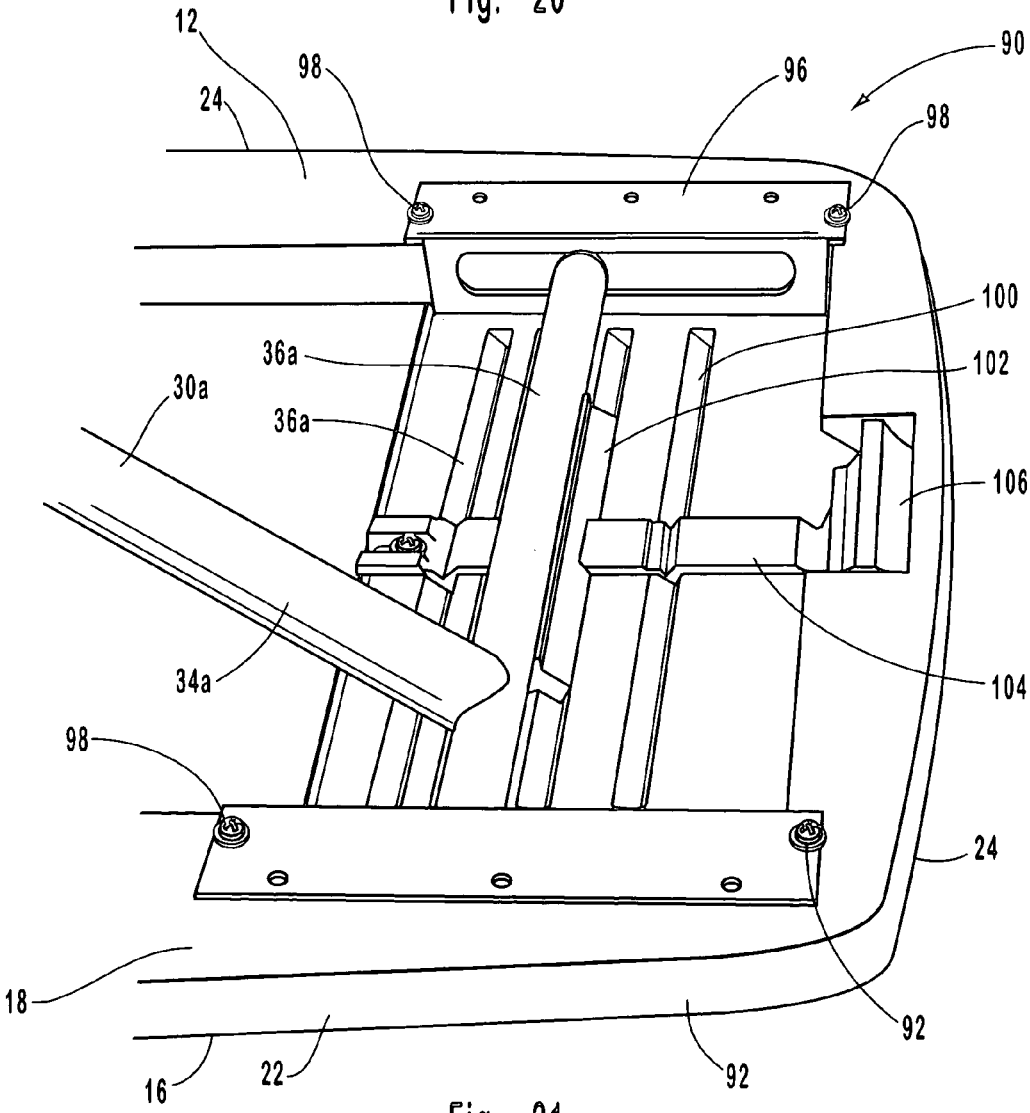
FIG. 21 is an enlarged bottom perspective view of a portion of the personal table shown in FIG. 20.
Figure 22:
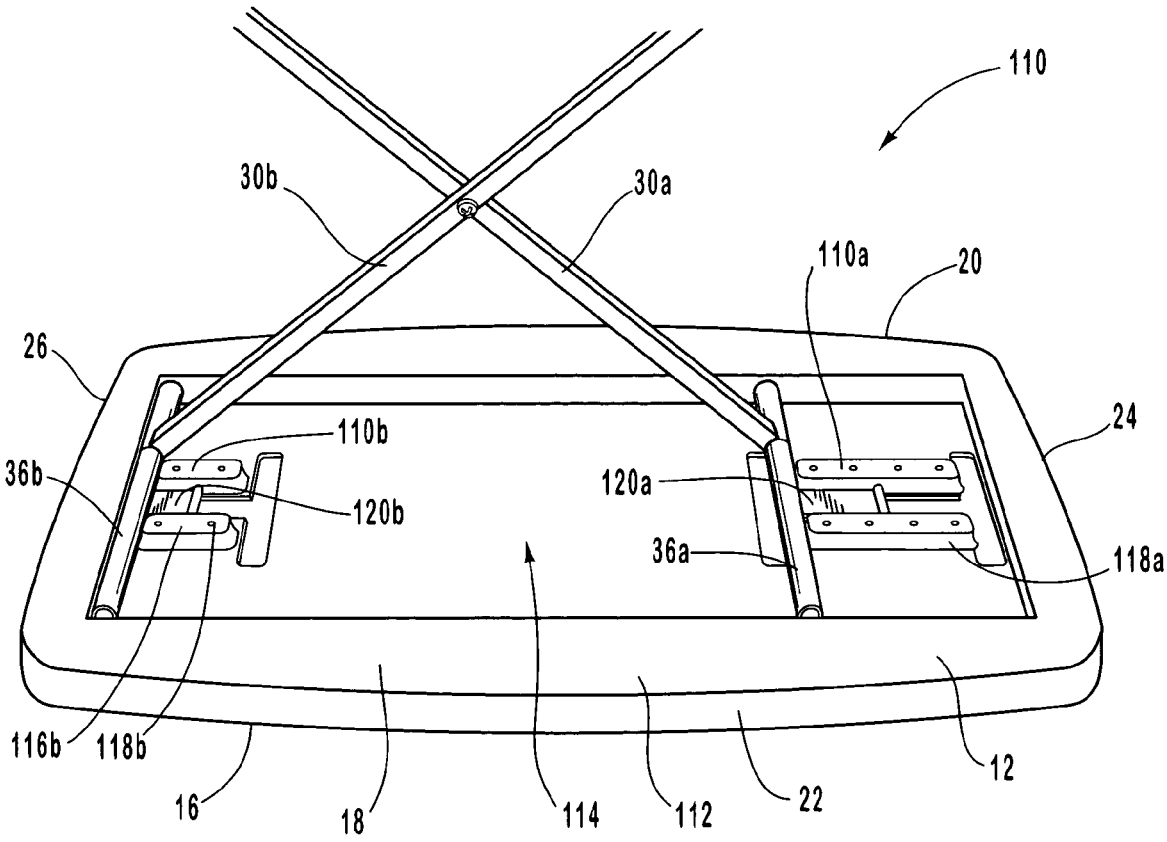
FIG. 22 is a bottom perspective view of a portion of a personal table in accordance with still another preferred embodiment of the present invention.

Another aspect is a personal table 90, as shown in FIGS. 20 and 21, which includes a table top 12 and a support assembly 14. The support assembly 14 includes legs 30*a*, 30*b* with a lower portion 32*a*, 32*b*, a body portion 34*a*, 34*b* and an upper portion 36*a*, 36*b*. The table top includes a lip 92 that is preferably disposed about the circumference of the table top and it encloses a central area 94. A leg attachment member 96 is preferably located proximate each end of the table top 12 and it is configured to allow the legs 30*a*, 30*b* to be connected to the table top. In particular, the leg attachment member 96 is preferably attached to the table top 12 by fasteners such as screws 98 and a plurality of grooves or channels 100 are formed in the leg attachment member. A receiving member 102 is sized and configured to be selectively attached to any of the desired grooves 100 and the receiving member allows the legs 30*a*, 30*b* to be selectively attached to the table top 12.

The receiving member 102, for example, may be selectively connected to a desired groove 100 in the leg attachment member 96 and an upper portion 36*a*, 36*b* of a leg 30*a*, 30*b* may be selectively or permanently attached to the receiving member. This allows the leg 30*a*, 30*b* to be attached to the table top 12. In greater detail, the receiving member 102 may be selectively connected to the groove 100 by a friction, snap or interference fit, or other suitable means. The receiving member 102 may also be attached to the leg attachment member 96 by a locking member 104 that includes a handle 106 disposed near an edge of the table top 12. The receiving member 102 may be selectively attached to a desired groove 100 by the locking member 104. The upper portion 36*a*, 36*b* of the leg 30*a*, 30*b* may be attached to the receiving member 102 either before or after the receiving member is attached to the groove 100. Alternatively, the leg 30*a*, 30*b* may be permanently attached to the receiving member 102.

As shown in FIG. 20, the legs 30*a*, 30*b* may be disposed in a collapsed position with the legs being positioned generally adjacent to the bottom surface 18 of the table top 12. In this collapsed position, the receiving members 102 are disposed in the grooves 100 proximate the edges of the table top 12. The receiving members 102 can then be released from the grooves 100 proximate the edges of the table top 12, for example by pulling the handle 106, and the receiving members are then connected to any desired groove 100 according to the desired height of the table 90.

Another aspect of a personal table 110 is shown in FIGS. 22 through 26. The personal table 110 includes a table top 12 with a lip 112 and a central area 114 that is enclosed by the lip. Attached to the bottom surface 18 of the table top 12, preferably in the central area 114, are two height adjustment members 116*a*, 116*b*. The height adjustment members 116*a*, 116*b* allow the height of table top 12 to be altered by changing the relative positioning of legs 30*a*, 30*b* with respect to one another. In particular, the height adjustment members 116*a*, 116*b* allow the distance separating the upper portions 36*a*, 36*b* of the legs 30*a*, 30*b* to be changed, which changes the height of the personal table 110.

In greater detail, the height adjustment members 116*a*, 116*b* preferably consist of dual hinge or pivoting members 118 with a connecting member 120 having a first end 122 and a second end 124. The first end 122 of the connecting member 120 is pivotally connected to the table top 12 by a base 123, but any suitable method may be used to attach the first end of the dual hinge member 118 to the table top. The second end 124 of the connecting member 120 is pivotally attached to the upper portion 36*a*, 36*b* of the legs 30*a*, 30*b*. Thus, the dual hinge members 118 are pivotally connected to the table top 12 and the legs 30*a*, 30*b*.

As illustrated in FIGS. 23–26, the lengths of the connecting members 120 are preferably different. That is, one connecting member 120 is preferably longer than the other connecting member. In addition, the dual hinge members 118 also allow the upper portions 36*a*, 36*b* of the legs 30*a*, 30*b* to be positioned in two different positions. In particular, the dual hinge members 118 allow the upper portions 36*a*, 36*b* of the legs 30*a*, 30*b* to be positioned towards an edge of the table top or towards the center of the table top. Because the dual hinge members 118 allow the upper portions 36*a*, 36*b* of the legs 30*a*, 30*b* to be positioned in two different locations and the connecting members 120 preferably have different lengths, that allows the legs to be positioned into four different configurations and the table to have corresponding different heights.

In greater detail, as shown in FIGS. 23–26, the first height adjusting member 116*a* may have a shorter connecting member 120 than the second height adjusting member 116*b*. For example, the length of the connecting member 120 of the first height adjustment member 116*a* may be approximately half the length of the connecting member of the second height adjustment member 116*b*. In particular, the length of the first height adjusting member 116*a* may be about one to two inches, and the length of the second height adjusting member 116*b* is preferably about five to six inches, but the connecting members may have any suitable length.

Figure 23:
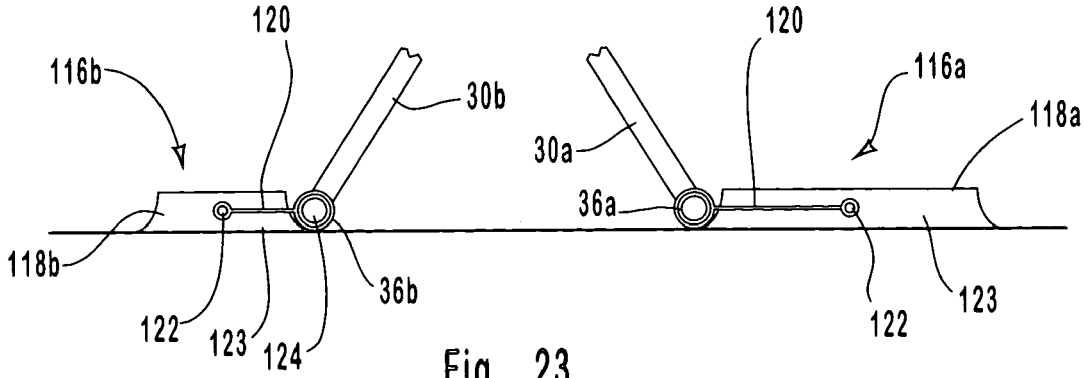
FIG. 23 is a partial schematic side view of a portion of the personal table shown in FIG. 22.
Figure 24:
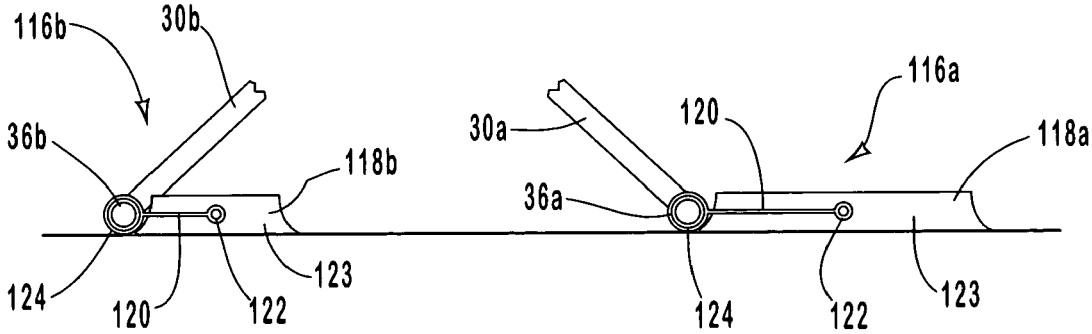
FIG. 24 is a partial schematic side view of a portion of the personal table shown in FIG. 22.
Figure 25:
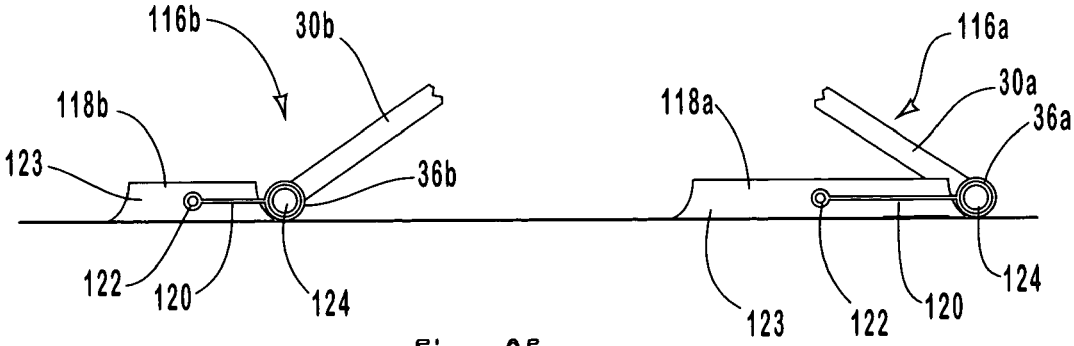
FIG. 25 is a partial schematic side view of a portion of the personal table shown in FIG. 22.
Figure 26:
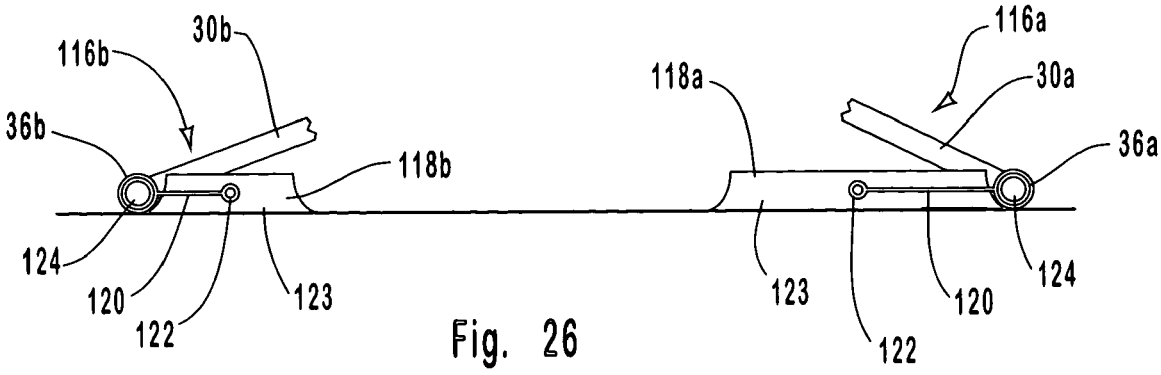
FIG. 26 is a partial schematic side view of a portion of the personal table shown in FIG. 22.

Because the dual hinge members 118 are movable between two different positions and the connecting members 120 have different lengths, the table may have four different heights. For example, as seen in FIG. 23, the first height adjustment member 116*a* has the upper portion 36*a* of the leg 30*a* disposed towards the center of the table top 12 and the second height adjustment member 116*b* has the upper portion 36*b* of the leg 30*b* disposed towards the center of the table top. This creates a table with a maximum height. FIG. 24 shows the first height adjustment member 116*a* has the upper portion 36*a* of the leg 30*a* disposed towards the center of the table top 12 and the second height adjustment member 116*b* has the upper portion 36*b* of the leg 30*b* disposed towards the edge of the table top. This creates a table with an intermediate height. FIG. 25 illustrates the first height adjustment member 116*a* disposed towards the edge of the table top 12 and the second height adjustment member 116*b* disposed towards the center of the table top to create a table with an intermediate height. FIG. 26 shows both the first height adjustment member 116*a* and the second height adjustment member 116*b* disposed towards the edges of the table top 12, which creates a table with a minimum height.

Advantageously, the height adjustment members 116*a*, 116*b* allow the table 110 to be readily adjusted to various suitable heights. Significantly, the various heights of the table 110 can be predetermined and designed for any suitable purpose. This provides great flexible and a wide variety of uses for the table. Further, the height adjustment members 116*a*, 116*b* can be used in connection with any suitable type of table or support structure.

Further, please note that the above description of the dual hinge members 118 is but one example of a height adjustment member that may be used to adjust the height of the table. Accordingly, one skilled in the art will recognize that various modifications may be made to the height adjustment members 116*a*, 116*b* in order to suit the needs of a particular application. It will also be understood that the table can be constructed with only a single height adjustment member 116. For example, one leg 30*a*, 30*b* could be coupled to table top 12 using a height adjustment member 116 while the other leg is attached to table top 12 using a standard hinge or pivotal connection.

Figure 27:
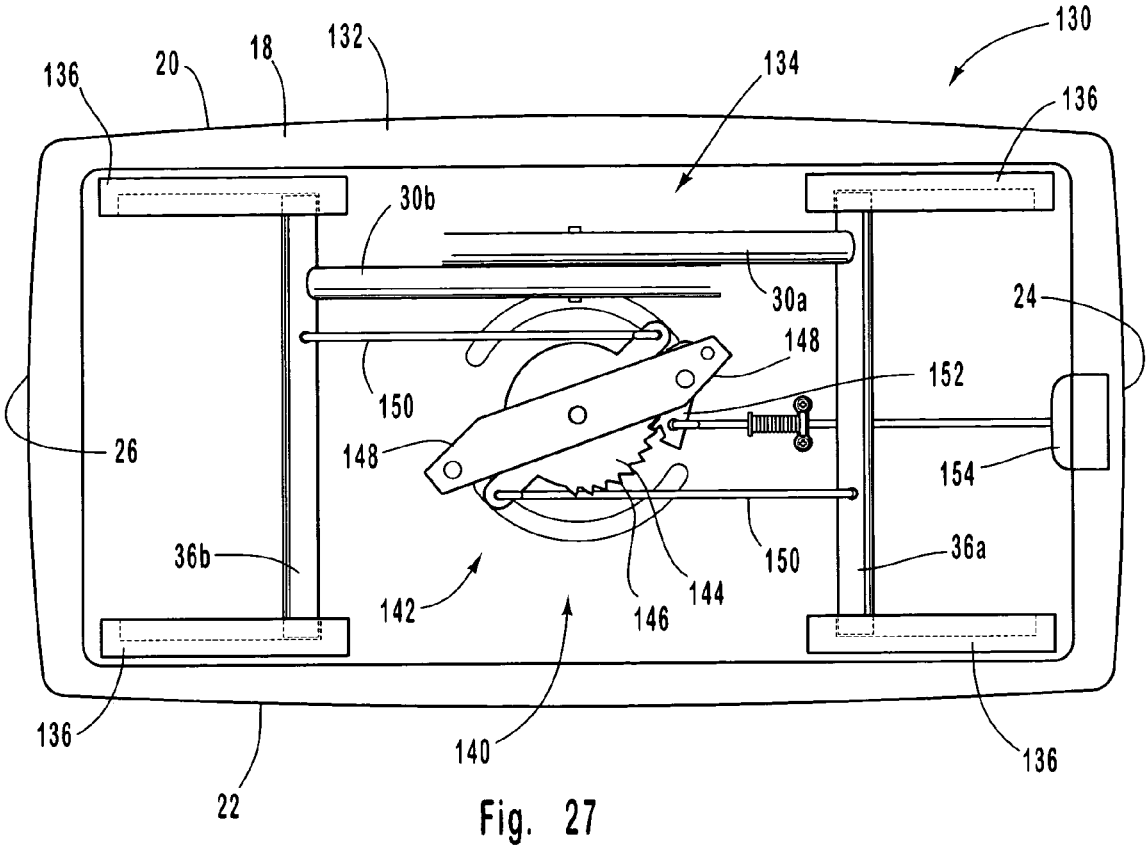
FIG. 27 is a bottom view of a personal table in accordance with yet another preferred embodiment of the present invention, illustrating a ratchet assembly in a first position.
Figure 28:
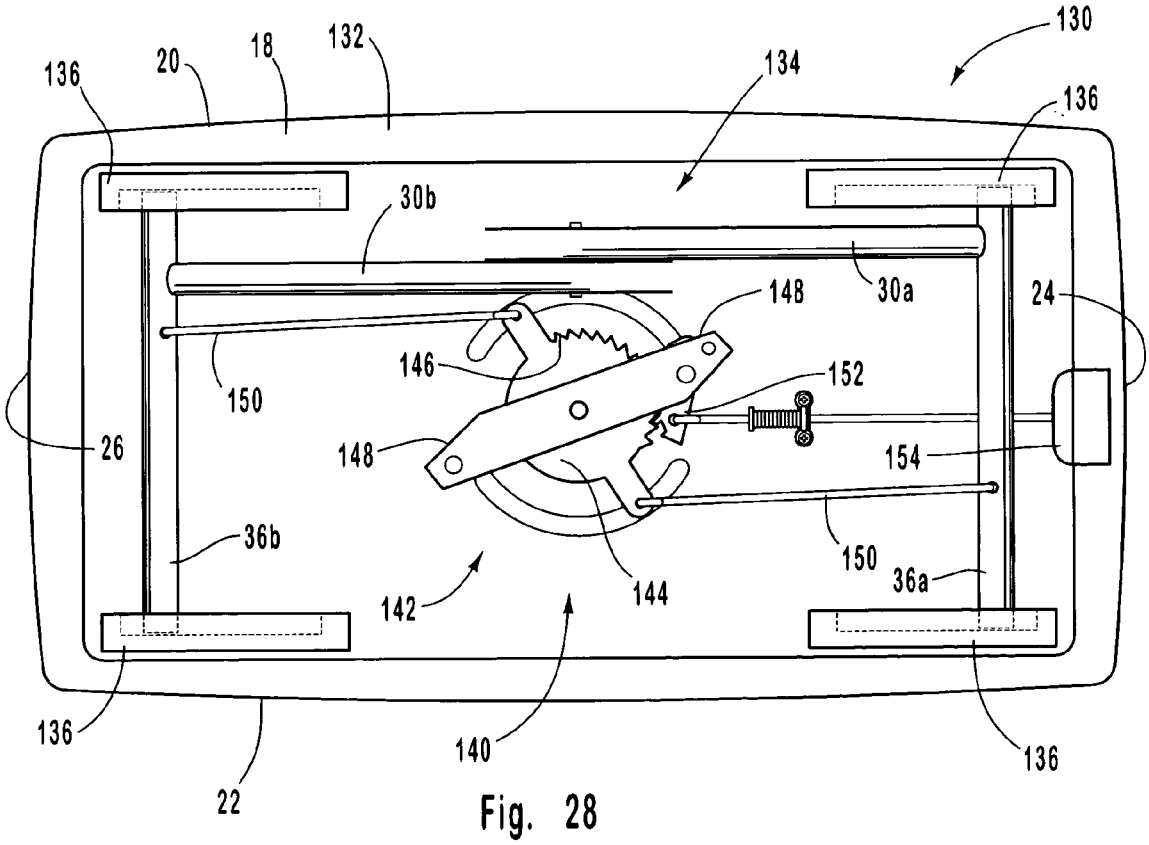
FIG. 28 is a bottom view of the personal table shown in FIG. 27, illustrating the ratchet assembly in a second position.

FIGS. 27 and 28 illustrate another aspect of a personal table 130 that includes a support assembly coupled to a table top. The personal table 130 includes a lip 132 and a central area 134 that is generally enclosed by the lip. Four brackets 136 are attached to the bottom surface 18 of the table top 12 and the brackets are preferably located in the corners of table top. The brackets 136 are attached to the table top 12 by fasteners such as screws, but any suitable means may be used to connect the brackets to the table top. The brackets 136 are preferably elongated members with a slot 136 disposed towards the center of table top 12. The ends of the upper portions 36*a*, 36*b* of the legs 30*a*, 30*b* are preferably disposed within opposing slots and the slots allow the upper portions of the legs to slide along the length of bracket 136. Because both the legs 30*a*, 30*b* are slidably received within brackets 136, it will be appreciated that the legs can be configured to adjust the height of table 130. Alternatively, only one leg 30*a*, 30*b* may be slidably coupled to table top 12 via the brackets 136.

The table 130 also includes a height adjustment mechanism 140 for selectively adjusting the height of the table by increasing or decreasing the distance between the upper portions 36*a*, 36*b* of legs 30*a*, 30*b*. The height adjustment mechanism 140 includes a ratchet assembly 142 that is pivotally connected to table top 12. The ratchet assembly 142 includes a gear 144 with a plurality of teeth 146 and a pair of outwardly extending arms 148. The arms 148 are attached to the legs 30*a*, 30*b* of the support assembly 14 by connectors 150 such as elongated rods. The ratchet assembly 142 also includes a pawl 152 that is configured to engage the teeth 146 on the gear 144. The pawl 152 is attached to a lever 154 that is accessible by a user at outer edge of table top 12.

As shown in FIG. 27, the gear 144 may be rotated in a clockwise direction to position the upper portions 36*a*, 36*b* of the legs 30*a*, 30*b* closer together. Alternatively, as shown in FIG. 28, the gear 144 may be rotated in a counter-clockwise direction and the upper portions 36*a*, 36*b* of the legs 30*a*, 30*b* may be moved apart. Similar to that described above, when the upper portions 36*a*, 36*b* of the legs 30*a*, 30*b* are spaced closer together, the height of the table increases. On the other hand, when the upper portions 36*a*, 36*b* of the legs 30*a*, 30*b* are spaced farther apart, the height of the table decreases. It will be appreciated that the ratchet assembly allows the table to have a plurality of different heights.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A personal table that is intended to be used by a single user, the personal table comprising:

a table top constructed from blow-molded plastic, the table top including an upper portion, a lower portion and a hollow interior portion formed during the blow-molding process; and a plurality of leg receiving portions integrally formed in the table top during the blow-molding process as part of a unitary, one-piece structure; and a single support assembly that is sized and configured to support the table top above a surface, the single support assembly being capable of moving between an extended position and a collapsed position, the single support assembly including only two leg support portions, the single support assembly comprising:

a first leg support portion including an upper section and a body section; and a second leg support portion including an upper section and a body section, the first leg support portion and the second leg support portion being pivotally connected, the first leg support portion and the second leg support portion having a generally X-shaped configuration in the extended position;

wherein at least one of the leg support portions is selectively connected in more than one fixed position relative to the table top to allow the height of the table to be adjusted when the single support assembly is in the extended position; and wherein at least one of the leg support portions is selectively connected to the table top to allow the single support assembly to be moved between the extended and collapsed positions.

2. The personal table as in claim 1, wherein the leg receiving portions are sized and configured to receive at least a portion of the upper section of one of the leg support portions.

3. The personal table as in claim 1, further comprising a receiving channel formed in a lower portion of the table top, the receiving channel being sized and configured to receive at least a portion of the body section of one of the leg support portions of the single support assembly when the single support assembly is in the collapsed position.

4. The personal table as in claim 1, further comprising a lip that extends generally downwardly from the table top, the lip being formed as part of a unitary, one-piece structure with the table top; and further comprising an opening in the lip that is sized and configured to receive a portion of the body section of at least one of the leg support portions of the single support assembly when the single support assembly is in the collapsed position.

5. The personal table as in claim 1, further comprising an opening in a sidewall of the table top that is sized and configured to receive at least a portion of the body section of at least one of the leg support portions of the single support assembly when the single support assembly is in the collapsed position.

6. The personal table as in claim 1, wherein the plurality of leg receiving portions includes at least three leg receiving portions formed in the table top as part of a unitary, one-piece structure, wherein the upper section of at least one of the leg support portions can be selectively removed from one of the at least three leg receiving portions and received within another of the at least three leg receiving portions to allow a height of the personal table to be adjusted.

7. The personal table as in claim 1, wherein the body section of the first leg support portion includes at least two elongated members and the body portion of the second leg support portion includes at least two elongated members.

8. The personal table as in claim 1, wherein the first leg support portion is permanently connected to the table top and the second leg support portion is selectively connected to the table top.

9. The personal table as in claim 1, further comprising a height adjustment mechanism for selectively increasing or decreasing a distance between the upper section of the first leg support portion and the upper section of the second leg support portion in order to increase or decrease the height of the personal table.

10. A personal table that is intended to be used by a single user and has a height that is adjustable, the personal table comprising:

a table top constructed from blow-molded plastic, the table top including an upper portion, a lower portion and a hollow interior portion formed during the blow-molding process;

at least one leg receiving portion integrally formed in the table top during the blow molding process as part of a unitary, one-piece construction; and a single support assembly that is sized and configured to allow the height of the table to be adjusted, the single support assembly including a single pair of leg support portions with a first leg support portion and a second leg support portion that are pivotally connected, the first leg support portion including an upper section and a body section, the second leg support portion including an upper section and a body section, the first leg support portion and the second leg support portion being movable between a first position in which the first leg and the second leg have a generally X-shaped configuration and a second position in which the first leg and the second leg are in a collapsed configuration.

11. The personal table as in claim 10, further comprising at least two leg receiving portions integrally formed in the table top as part of a unitary one-piece construction, the upper section of the first leg support portion being sized and configured to be selectively received and retained within one of the leg receiving portions, the upper section of the second leg support portion being sized and configured to be selectively received and retained within another of the leg receiving portions.

12. The personal table as in claim 11, wherein the first leg support portion can be selectively removed from one of the leg receiving portions and received within another of the leg receiving portions to allow the height of the personal table to be adjusted.

13. The personal table as in claim 10, further comprising at least one retaining member positioned adjacent to each of the at least one leg receiving portions, the retaining member being integrally formed in the table top as part of the unitary one-piece construction, the retaining member being sized and configured to retain a leg support portion within a leg receiving portion.

14. The personal table as in claim 10, wherein the first leg support portion is permanently connected to the table top and the second leg support portion is selectively connected to the table top.

15. The personal table as in claim 10, wherein the body section of the first leg support portion includes at least two elongated members and the body portion of the second leg support portion includes at least two elongated members.

16. A personal table that is sized and configured to be used by a single person and the table being adjustable in height, the personal table comprising:

a blow-molded plastic table top including an upper portion, a lower portion and a hollow interior portion formed during the blow-molding process;

a single support assembly that is at least partially selectively connected to the table top, the single support assembly being selectively movable between an extended position and a collapsed position, the single support assembly including a single pair of leg support portions that are pivotally connected, the single pair of leg support portions having a generally X-shaped configuration when the single support assembly is in the extended position, the single pair of leg support portions being generally positioned adjacent to each other in the collapsed position; and a plurality of leg receiving portions integrally formed in the table top as part of a unitary, one-piece structure, the leg receiving portions being sized and configured to interchangeably receive and retain a portion of the single support assembly in a generally fixed position relative to the table top to allow the height of the personal table to be adjusted.

17. The personal table as in claim 16, further comprising an opening in a side wall of the table top, the opening being sized and configured to allow at least a portion of the single leg support assembly to extend through the opening when the legs are in the collapsed position.

18. The personal table as in claim 17, wherein the opening is sized and configured to receive and retain the legs in a snap fit configuration when the legs are in the collapsed position.

19. The personal table as in claim 16, wherein each of the leg support portions include an elongated upper attachment portion that is sized and configured to be received and retained within the leg receiving portions.

20. The personal table as in claim 16, wherein each of the leg support portions includes an elongated body and each elongated body includes at least two elongated members.

21. A personal table that is intended to be used by a single user, the personal table comprising:

a table top constructed from plastic, the table top including an upper portion, a lower portion and a sidewall;

a plurality of leg receiving portions integrally formed in the table top as part of a unitary, one-piece structure;

a single support assembly that is sized and configured to support the table top above a surface, the single support assembly being capable of moving between an extended position and a collapsed position, the single support assembly including only two leg support portions, the single support assembly comprising:

a first leg support portion including an upper section and a body section; and a second leg support portion including an upper section and a body section, the first leg support portion and the second leg support portion being pivotally connected, the first leg support portion and the second leg support portion having a generally X-shaped configuration in the extended position;

wherein at least one leg support portion is selectively connected in more than one fixed position relative to the table top to allow the height of the table to be adjusted when the single support assembly is in the extended position; and wherein at least one leg support portion is selectively connected to the table top to allow the single support assembly to be moved between the extended and collapsed positions; and an opening in the sidewall of the table top that is sized and configured to receive at least a portion of the body section of a leg support portion of the single support assembly when the single support assembly is in the collapsed position.

22. The personal table as in claim 21, wherein the leg receiving portions are sized and configured to receive at least a portion of the upper section of one of the leg support portions.

23. The personal table as in claim 21, further comprising a receiving channel formed in a lower portion of the table top, the receiving channel being sized and configured to receive at least a portion of the body section of at least one of the leg support portions of the single support assembly when the single support assembly is in the collapsed position.

24. The personal table as in claim 21, wherein the plurality of leg receiving portions includes at least three leg receiving portions formed in the table top as part of a unitary, one-piece structure, wherein the upper section of one of the leg support portions can be selectively removed from one of the at least three leg receiving portions and received within another of the at least three leg receiving portions to allow a height of the personal table to be adjusted.

25. The personal table as in claim 21, wherein the body section of the first leg support portion includes at least two elongated members and the body portion of the second leg support portion includes at least two elongated members.

26. The personal table as in claim 21, wherein the first leg support portion is permanently connected to the table top and the second leg support portion is selectively connected to the table top.

27. The personal table as in claim 21, further comprising a height adjustment mechanism for selectively increasing or decreasing a distance between the upper section of the first leg support portion and the upper section of the second leg support portion in order to increase or decrease the height of the personal table.

* * * * *

UNITED STATES PATENT AND TRADEMARK OFFICE

CERTIFICATE OF CORRECTION

PATENT NO. : 7,263,932 B2
APPLICATION NO. : 11/038375
DATED : September 4, 2007
INVENTOR(S) : Winter et al.

It is certified that error appears in the above-identified patent and that said Letters Patent is hereby corrected as shown below:

Column 11
Line 37, change "36" to --36b--

Column 14
Line 17, before "preferably", remove [a]

Signed and Sealed this

Eighth Day of July, 2008

JON W. DUDAS
*Director of the United States Patent and Trademark Office*